US010260313B2

(12) United States Patent
Urdaneta Nava et al.

(10) Patent No.: US 10,260,313 B2
(45) Date of Patent: Apr. 16, 2019

(54) METAL-TO-METAL SEALING VALVE WITH MANAGED FLOW EROSION ACROSS SEALING MEMBER

(71) Applicant: Weatherford Technology Holdings, LLC, Houston, TX (US)

(72) Inventors: Luis A. Urdaneta Nava, Cypress, TX (US); Paul Andrew Reinhardt, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 183 days.

(21) Appl. No.: 15/088,770

(22) Filed: Apr. 1, 2016

(65) Prior Publication Data

US 2016/0290101 A1 Oct. 6, 2016

Related U.S. Application Data

(60) Provisional application No. 62/141,518, filed on Apr. 1, 2015.

(51) Int. Cl.

| | |
|---|---|
| ***E21B 33/14*** | (2006.01) |
| ***E21B 34/00*** | (2006.01) |
| ***E21B 34/10*** | (2006.01) |
| ***E21B 34/14*** | (2006.01) |

(52) U.S. Cl.

CPC ..... *E21B 34/10* (2013.01); *E21B 33/14* (2013.01); *E21B 34/14* (2013.01); *E21B 2034/007* (2013.01)

(58) Field of Classification Search

CPC ..... E21B 33/14; E21B 34/10; E21B 34/14; E21B 2034/007; E21B 17/08

See application file for complete search history.

(56) References Cited

U.S. PATENT DOCUMENTS 2,429,912 A * 10/1947 Baker ..... E21B 33/14 137/496
2,602,510 A * 7/1952 Baker ..... E21B 33/14 137/68.17
2,618,339 A 11/1952 Glover
2,928,470 A * 3/1960 Baker ..... E21B 33/14 166/154

(Continued)

FOREIGN PATENT DOCUMENTS

WO WO-2016161306 A1 * 10/2016 ..... E21B 33/14

OTHER PUBLICATIONS

PCT International Search Report and Written Opinion dated Jun. 13, 2016, for International Patent Application No. PCT/US2016/025589.

(Continued)

*Primary Examiner* — Jennifer H Gay
(74) *Attorney, Agent, or Firm* — Patterson + Sheridan, LLP

(57) ABSTRACT

A method and apparatus for filling an annulus between a wellbore and a casing string with cement are provided. A baffle is arranged between a port on a side of the casing string and an interior volume of the casing string. The baffle includes orifices arranged there around that distribute the flow of cement about the circumference. After the cement has been pumped, a sealing sleeve is moved over the baffle and the port and forms a metal-to-metal seal that isolates the baffle and the port from the interior volume of the casing string.

23 Claims, 21 Drawing Sheets

(56) References Cited

U.S. PATENT DOCUMENTS 3,527,297 A * 9/1970 Todd ..... E21B 33/146 166/154
3,768,556 A * 10/1973 Baker ..... E21B 34/10 166/320
4,429,747 A * 2/1984 Williamson, Jr. ..... E21B 34/14 166/321
4,669,541 A * 6/1987 Bissonnette ..... E21B 34/14 166/154
5,316,084 A * 5/1994 Murray ..... E21B 33/1208 166/332.4
6,422,317 B1 * 7/2002 Williamson, Jr. ..... E21B 34/10 166/320
6,513,595 B1 * 2/2003 Freiheit ..... E21B 34/14 166/332.4
6,817,416 B2 * 11/2004 Wilson ..... E21B 34/06 166/332.1
7,866,402 B2 * 1/2011 Williamson, Jr. .... E21B 21/103 166/319
9,856,714 B2 * 1/2018 Giroux ..... E21B 33/146
2007/0240883 A1 * 10/2007 Telfer ..... E21B 33/10 166/375
2009/0056952 A1 * 3/2009 Churchill ..... E21B 21/10 166/373
2010/0163253 A1 * 7/2010 Caldwell ..... E21B 33/146 166/387
2010/0206572 A1 * 8/2010 Makowiecki ..... E21B 33/146 166/332.1
2010/0224371 A1 * 9/2010 Swan ..... E21B 21/103 166/373
2011/0278016 A1 * 11/2011 Xu ..... E21B 34/10 166/373
2012/0247767 A1 * 10/2012 Themig ..... E21B 21/103 116/289
2013/0087323 A1 * 4/2013 Allamon ..... E21B 34/063 166/192
2014/0083713 A1 * 3/2014 Budler ..... E21B 23/04 166/373
2014/0224479 A1 * 8/2014 Andrigo ..... E21B 33/14 166/192
2015/0267494 A1 * 9/2015 Wesson, Jr. ..... E21B 31/1135 166/373
2015/0330180 A1 * 11/2015 Barannikow ..... E21B 33/12 166/285
2016/0102526 A1 * 4/2016 Wind ..... E21B 33/146 166/289
2016/0290101 A1 * 10/2016 Urdaneta Nava ..... E21B 33/14

OTHER PUBLICATIONS

International Report on Patentability in related application PCT/US2016/025589 dated Oct. 12, 2017.

* cited by examiner

METAL-TO-METAL SEALING VALVE WITH MANAGED FLOW EROSION ACROSS SEALING MEMBER

CROSS-REFERENCE TO RELATED APPLICATIONS

This application claims benefit of U.S. provisional patent application Ser. No. 62/141,518, filed Apr. 1, 2015, which is herein incorporated by reference.

BACKGROUND OF THE INVENTION

Field of the Invention

Embodiments of the present invention generally relate to a casing string for a wellbore.

Description of the Related Art

Wellbores typically include a casing string that structurally supports the walls of the wellbore and isolates the wellbore from the surrounding geological formations. In many instances, an annular gap between the wellbore and the casing is filled with cement. Referring to FIG. 1A, a well 100 includes a wellbore 102 that is formed by a drill bit. When the wellbore 102 reaches a depth at which the walls of the wellbore may collapse (e.g., due to pressures exerted by the surrounding geological formations), a casing string 110 is placed in the wellbore. The casing string 110 is first positioned in the wellbore 102. Then, a cement slurry is pumped through the casing string 110 and out through one or more openings 114 at the bottom of the casing string 110. For example, the casing string 110 may include a shoe that guides the casing string 110 into the wellbore 102. The shoe can include one or more ports through which the cement slurry can pass into the annular gap 120 (in the direction of arrow A). The cement slurry can be pumped so that it travels through the wellbore 102 back toward the surface in the annular gap 120 between the walls 112 of the casing string 110 and the wellbore 102.

In various instances, the cement slurry may not be able to be pumped through the annular gap 120 to the top of the wellbore 102 (or the top of the casing string 110). As an illustration, the cement slurry may only be pumped to a height indicated by dashed line 122 in the annular gap 120. For example, a cement slurry pump may only provide sufficient pressure to pump the cement slurry to the height of the dashed line 122. As another example, pumping the cement slurry to a height above the dashed line 122 may require a hydrostatic and/or applied pressure of the cement slurry that exceeds a fracture pressure of geological structures surrounding the wellbore 102. In such instances, a port 116 can be included in the casing string through which the cement slurry can flow (in the direction of arrow B). As the cement slurry reaches the height of the dashed line 122, a plug can be sent through the casing string 110 that closes off the openings 114 at the bottom of the casing string. The plug also pushes remaining cement slurry out of the casing string 110 and into the annular gap 120. After the plug reaches the bottom of the casing string, pressure within the casing string increases until a rupture disc in the port 116 bursts, enabling cement slurry to flow out of the port in the direction of arrow B. The cement slurry can then fill the annular gap 120 above the dashed line 122. The casing string 110 may include more than one port 116 along its length, and the above-described process of plugging the casing string and bursting a rupture disc can be sequentially repeated to fill the annular gap 120 with cement slurry. Additionally, the casing string 110 may include more than one port 116 at each lengthwise location.

By providing multiple ports and rupture discs at each location, redundancy can be provided in case a rupture disc fails to burst.

FIGS. 1B-1D illustrate in greater detail a process for providing cement slurry to the annular gap 120 between the wellbore 102 and the walls 112 of the casing string 110. FIG. 1B shows a first casing string section 112*a* and a second casing string section 112*b* that are joined by a body 118. For example, the first casing string section 112*a* can include external threads that engage internal threads on the body 118. Similarly, the second casing string section 112*b* can include external threads that engage internal threads on the body 118. The first casing string section 112*a* and the second casing string section 112*b* are separated by a gap 130 when they are engaged in the body 118. The body 118 includes a port 132 therethrough. The port 132 includes a rupture disc 116 that temporarily blocks the port 132 and prevents cement slurry from flowing through the port 132 and into the annular gap 120 between the casing string sections 112*a*, 112*b* and the wellbore 102. A sealing sleeve 140 is arranged in the first casing string section 112*a* at a location that is upstream from the gap 130 and the port 132. The sealing sleeve 140 can include one or more resilient members 142 at an upstream end and one or more resilient members 144 at a downstream end. In FIG. 1B, the cement slurry is moving past the port 132 toward the downhole end of the casing string 110, as indicated by arrow A. As discussed above, after the cement slurry has been pumped through the annular gap 120 to a particular height (or when a threshold hydrostatic and/or applied pressure of the cement slurry has been reached), a plug, dart, or the like can be sent through the casing string 110 to block openings through which the cement slurry is passing to reach the annular gap 120. Thereafter, a pressure rise within the casing string 110 causes the rupture disc 116 to burst. FIG. 1C shows the port 132 after the rupture disc has burst. After the rupture disc 116 has burst, cement slurry can flow out through the port 132 as indicated by arrow B.

Within the casing string 110, the cement slurry flows past the walls of the casing sections 112*a* and 112*b* proximate to the port. As a result, the walls of the casing sections 112*a* and 112*b* proximate to the port may suffer erosion from the flowing cement slurry, as indicated by rounded portions 134 of the walls of the casing sections 112*a* and 112*b*. By contrast, a side of the casing string 110 opposite the port 132 may not suffer any erosion because the cement slurry is generally stagnant at that location.

After the cement slurry has been pumped through the port 132, the port 132 can be isolated and sealed by moving the sealing sleeve 140 in the direction of arrow C, as shown in FIG. 1D. For example, a plug or a dart can be sent through the casing section 112*a* to push the sealing sleeve 140. After the sealing sleeve 140 has been moved, the resilient members 142 at the upstream end of the sealing sleeve and the resilient members 144 at the downstream end of the sealing sleeve press against the walls of the casing string sections 112*a* and 112*b* to isolate the port 132 from the interior of the casing string 110. The resilient members 142 and 144 are used because the erosion of the walls of the casing string 110 caused by the cement slurry (indicated by rounded portions 134) can result in an irregular surface finish to the interior of the walls of the casing string 110. The resilient members 142 and 144 conform to such irregular surfaces to provide a seal. However, such resilient members 142 and 144 may lack long-term durability. For example, resilient members made of rubber, plastic, or a polymer may degrade over time and allow oil, gas, and/or a drilling fluid to reach the cement in the annulus 120. The oil, gas, or drilling fluid could weaken the cement in the annulus 120 and possibly compromise the well 100.

SUMMARY OF THE INVENTION

According to one embodiment, a casing string collar for use with a casing string for a wellbore includes a tubular body having a port. The casing string collar also includes a baffle between the port and an interior volume of the tubular body, wherein the baffle includes a plurality of orifices arranged around the baffle. The casing string collar also includes a sealing sleeve that is movable from a first position to a second position, wherein the sealing sleeve forms at least one metal-to-metal seal that isolates the port and the baffle from the interior volume of the tubular body when the sealing sleeve is moved to the second position.

According to one embodiment, a casing string for a wellbore includes a first casing string section and a second casing string section. The casing string also includes a casing string collar arranged between the first casing string section and the second casing string section. The casing string collar includes a first port. The casing string collar also includes a baffle between the port and an interior volume of the casing string collar. The baffle includes a plurality of orifices arranged around the baffle. The casing string collar also includes a sealing sleeve that is movable from a first position to a second position. The sealing sleeve forms at least one metal-to-metal seal that isolates the port and the baffle from the interior volume of the casing string collar when the sealing sleeve is moved to the second position.

According to one embodiment, a method of arranging cement in an annulus between a wellbore and a casing string includes pumping cement slurry through a baffle and through a port, wherein the baffle and the port are arranged between a first casing section and a second casing section of the casing string, and wherein the baffle includes a plurality of orifices about a circumference through which the cement slurry can flow. The method also includes moving a sealing sleeve from a first position to a second position, wherein the sealing sleeve forms a metal-to-metal seal that isolates the baffle and the port from an interior volume of the casing string in the second position.

According to one embodiment, a casing string collar for a casing string includes a box sub that includes a distal end. The box sub includes a first sealing element arranged around an interior surface proximate to the distal end. The distal end includes a first non-uniform edge. The casing string collar also includes a pin sub that includes a proximal end. The pin sub includes a second sealing element arranged around an interior surface proximate to the proximal end. The proximal end includes a second non-uniform edge. The casing string collar also includes a body that is engaged with the box sub and the pin sub. The first non-uniform edge of the box sub and the second non-uniform edge of the pin sub are spaced apart by a gap that includes a wide region and a narrow region when engaged with the body. The body defines a first port and the narrow region is aligned relative to the port. The casing string collar also includes a sealing sleeve arranged in the box sub. The sealing sleeve is movable toward the pin sub from a first position to a second position. The sealing sleeve includes a first sealing surface arranged to seal against the first sealing element of the box sub when the sleeve is moved to the second position. The sealing sleeve also includes a second sealing surface arranged to seal against the second sealing element of the pin sub when the sleeve is moved to the second position.

According to one embodiment, a casing string collar for a casing string includes a box sub that includes a distal end. The box sub includes a first sealing element arranged around an interior surface proximate to the distal end. The casing string collar also includes a pin sub that includes a proximal end. The pin sub includes a second sealing element arranged around an interior surface proximate to the proximal end. The casing string collar also includes a body that is engaged with the box sub and the pin sub. The distal end of box sub and the proximal end of the pin sub are spaced apart by a gap when engaged with the body. The body defines a first port. The casing string collar also includes a baffle arranged in the body. The baffle includes a cylindrical surface that covers the gap between the proximal end of the pin sub and the distal end of the box sub. The cylindrical surface includes a plurality of orifices arranged about a circumference of the cylindrical surface. The cylindrical surface is oriented to align an orifice relative to the first port in the cylindrical body. The casing string collar also includes a sealing sleeve configured to selectively engage the first sealing element and the second sealing element to close the port from fluid communication.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In various embodiments described herein, a casing string collar is provided for insertion between two casing sections of a casing string. The casing string collar defines at least one port and a rupture disc therein. The casing string collar includes a sealing collar therein that can be moved to form a metal-to-metal seal over the at least one port, thereby isolating and sealing the at least one port from the interior of the casing string. The casing string collar also includes a baffle arranged between the port at least one in the interior of the casing string collar. The baffle includes a plurality of orifices with varying sizes. The orifices can evenly distribute the flow of cement slurry about a circumference of the casing string collar to minimize erosion sealing surfaces of the casing string collar.

Figure 2A:
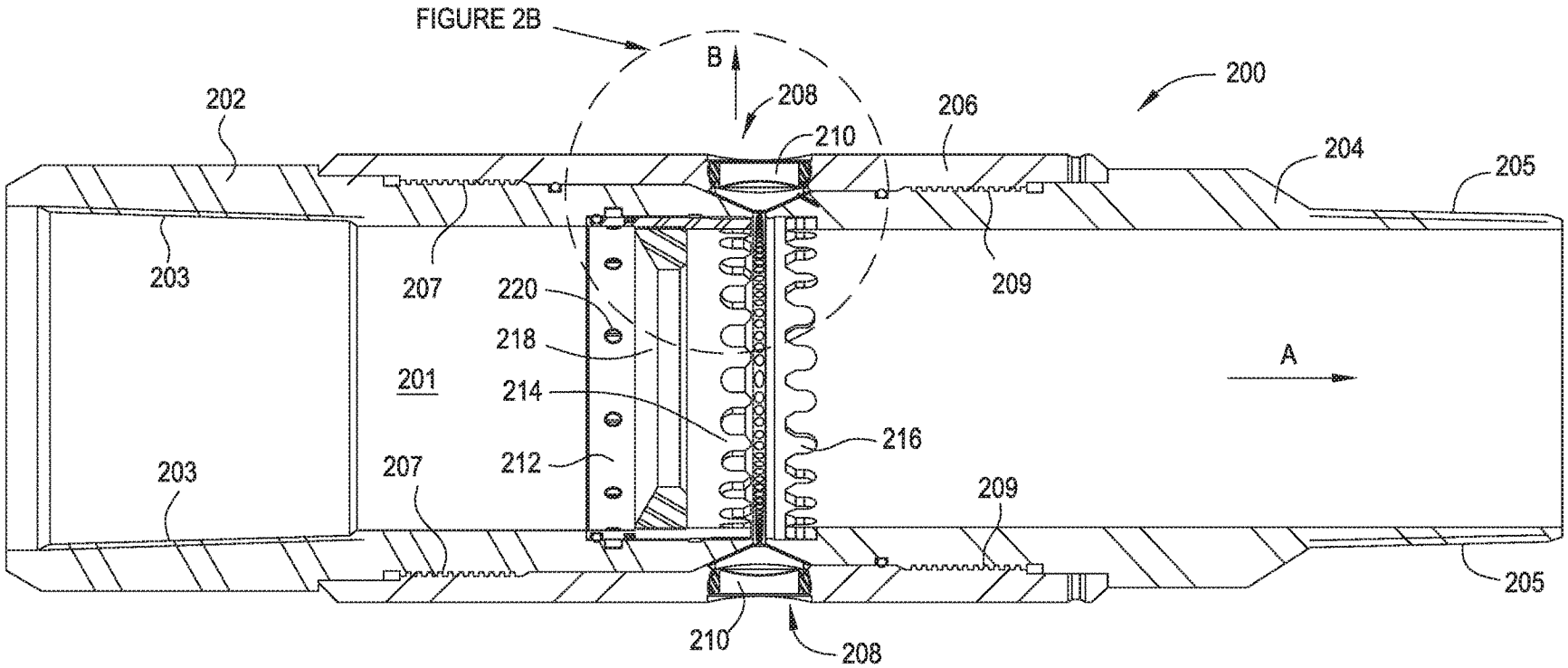
FIG. 2A is a cross-sectional side view of a casing string collar for insertion in a casing string between two casing string sections, wherein the casing string collar includes two ports for releasing cement slurry into an annular gap between the casing string and the wellbore, and wherein a sealing sleeve is arranged in an unsealed position.
Figure 2B:
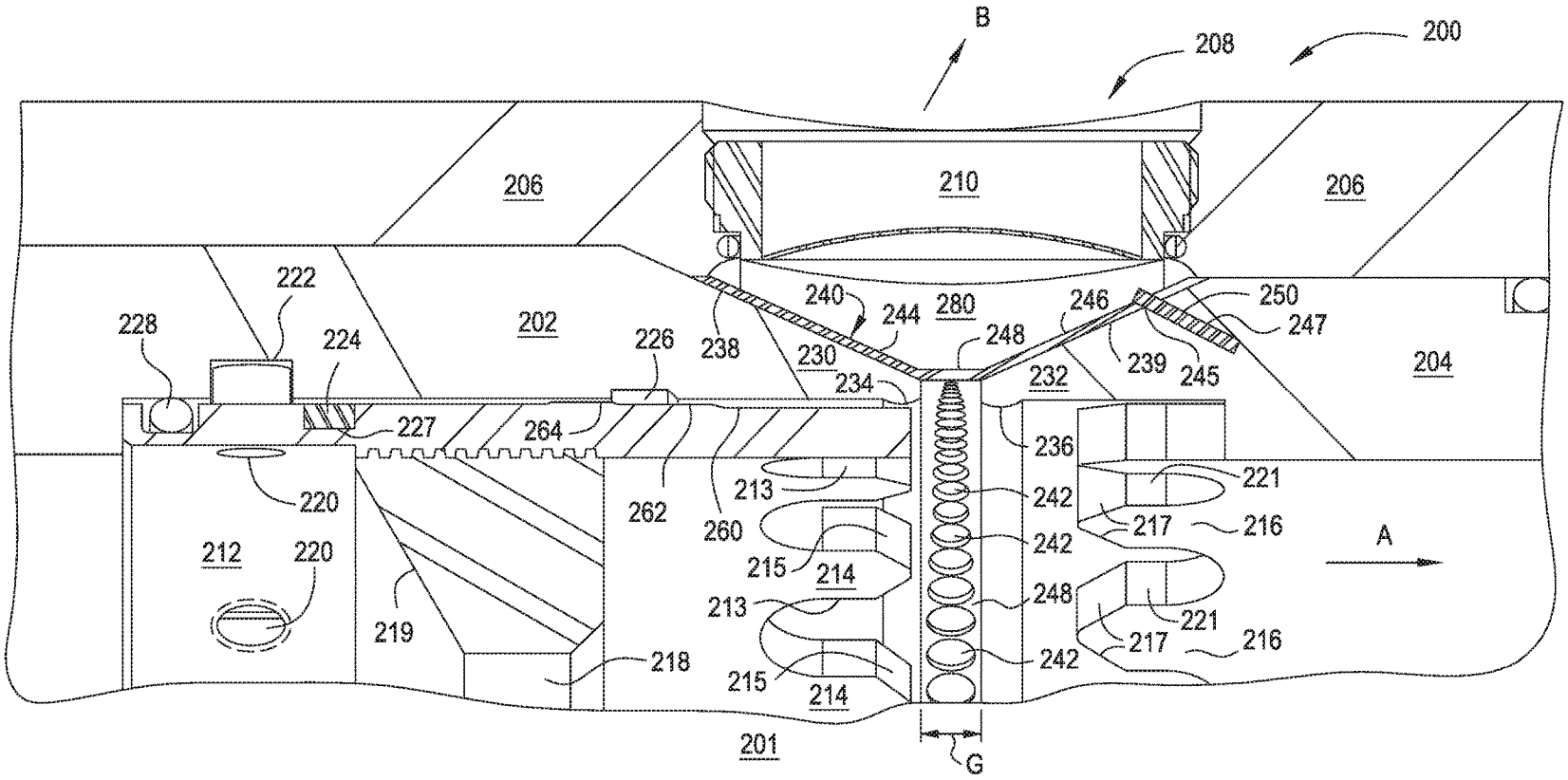
FIG. 2B is a cross-sectional detail side view of the casing string collar of FIG. 2A.

FIGS. 2A and 2B illustrate a cross-sectional side view of a casing string collar 200 according to various embodiments. The casing string collar 200 includes a box sub 202 and a pin sub 204 that are engaged with a body 206. For example, the box sub 202 can engage the body 206 via mating threads 207. Similarly, the pin sub 204 can engaged the body 206 via mating threads 209. The box sub 202 can include interior threads 203 that can engage an upstream casing section and the pin sub 204 can include external threads 205 that can engage a downstream casing section. In use, the casing string collar 200 can be attached to the upstream end of a casing section that has already been inserted into a wellbore by engaging the external threads 205 of the pin sub 204 with internal threads on the upstream end of the casing section. Then, a downstream end of a new casing section can be attached to the box sub 202 by engaging the internal threads 203 of the box sub 202 with external threads on the downstream end of the new casing section. In an alternative use, the casing string collar 200 can be made up with an upstream casing section and a downstream casing section away from the wellbore, and the assembled casing sections with the casing string collar 200 therebetween can then be made up with casing string sections already arranged in the wellbore.

The body 206 includes at least one port 208, and each port 208 includes a rupture disc 210 arranged therein. In the embodiment shown in FIGS. 2A and 2B, two ports 208 with respective rupture discs 210 are shown. Including more than one port and rupture disc can provide redundancy; if a first rupture disc fails to burst at the appropriate hydrostatic and/or applied pressure level, then a second rupture disc likely will burst at the appropriate pressure level. Once one of the rupture discs bursts, the hydrostatic pressure and/or applied level will decrease and the remaining rupture disc(s) will not burst.

The box sub 202 includes a sealing sleeve 212 arranged therein. The sealing sleeve 212 is held in place relative to the box sub 202 by a plurality of shear screws 220, which are engaged with threaded holes 222 in the box sub 202. In various other embodiments, the shear screws 220 engage threaded holes in the sealing sleeve 212 and protrude past the sealing sleeve 212 into holes 222 in the box sub 202. The sealing sleeve 212 can also include a snap ring 224 arranged in a slot 227 formed in the sealing sleeve 212. As will be described in greater detail below, when the sealing sleeve 212 moves to seal the at least one port 208, the snap ring 224 can move radially outward to engage a slot 226 in the box sub 202. The sealing sleeve 212 may optionally include an O-ring 228 (e.g., made of a resilient material such as rubber) that can prevent cement slurry from seeping between the box sub 202 and the sealing sleeve 212. The sealing sleeve 212 also includes a plug seat 218. The plug seat 218 includes a surface 219 that can mate with a surface of a plug, dart, or the like that travels down the casing string (described in greater detail below).

A distal end of the sealing sleeve 212 includes a plurality of anti-rotation fingers 214. As used herein, "distal" refers to a direction that is toward the bottom of the wellbore and "proximal" refers to a direction that is toward the surface of the wellbore. The anti-rotation fingers 214 includes angled surfaces 215 toward the distal end of the anti-rotation fingers 214 and mating surfaces 213 along the sides of the anti-rotation fingers 214. A proximal end of an interior wall of the pin sub 204 includes similar anti-rotation fingers 216 formed therein. The anti-rotation fingers 216 include angled surfaces 217 toward the proximal end of the anti-rotation fingers 216 and mating surfaces 221 along the sides of the anti-rotation fingers 216. As described in greater detail below, with the sealing sleeve 212 is moved to seal the at least one port 208, the anti-rotations fingers 214 on the sealing sleeve 212 engage the anti-rotation fingers 216 in the pin sub 204 to prevent the sealing sleeve 212 from rotating relative to the pin sub 204 or the box sub 202. Rotation of the sealing sleeve 212 after the metal-to-metal seals have been made (discussed below) could cause wear to the sealing surfaces and allow leaks to develop. In the event the anti-rotation fingers 214 and 216 are not properly aligned, the angled surfaces 215 and 217 can cause the sealing sleeve 212 to rotate relative to the pin sub 204 and the box sub 202 to align the anti-rotation fingers 214 and 216.

Figure 6B:
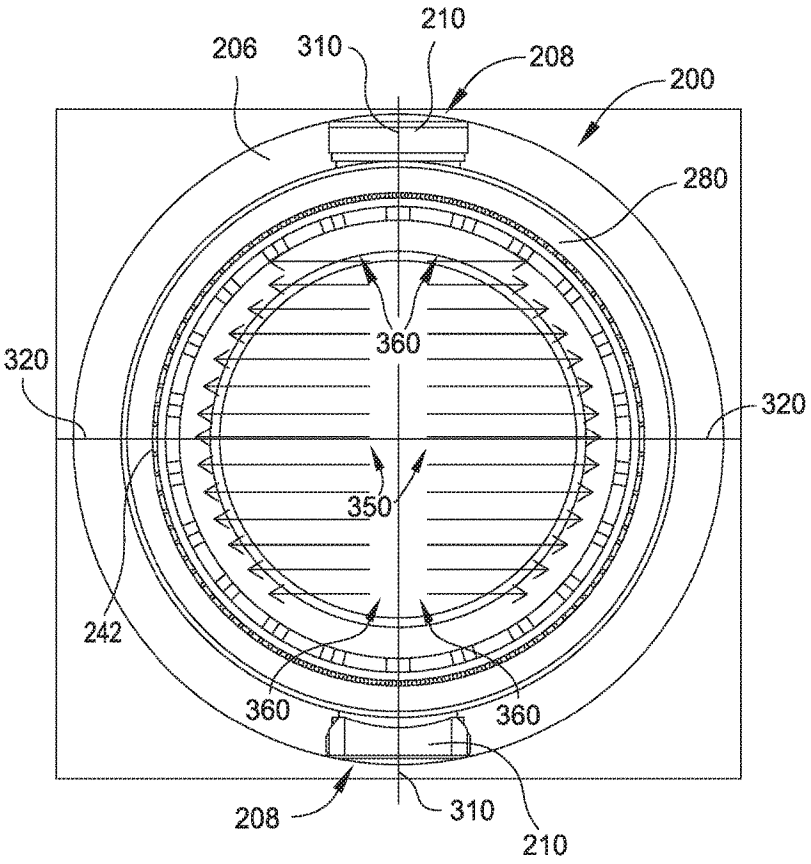
FIG. 6B is a cross-sectional end view of the casing string collar of FIG. 2A, wherein arrows represent flow of cement slurry through orifices in a baffle, and wherein lengths of the arrows represent relative amounts of flow through the orifices in the baffle.
Figure 6A:
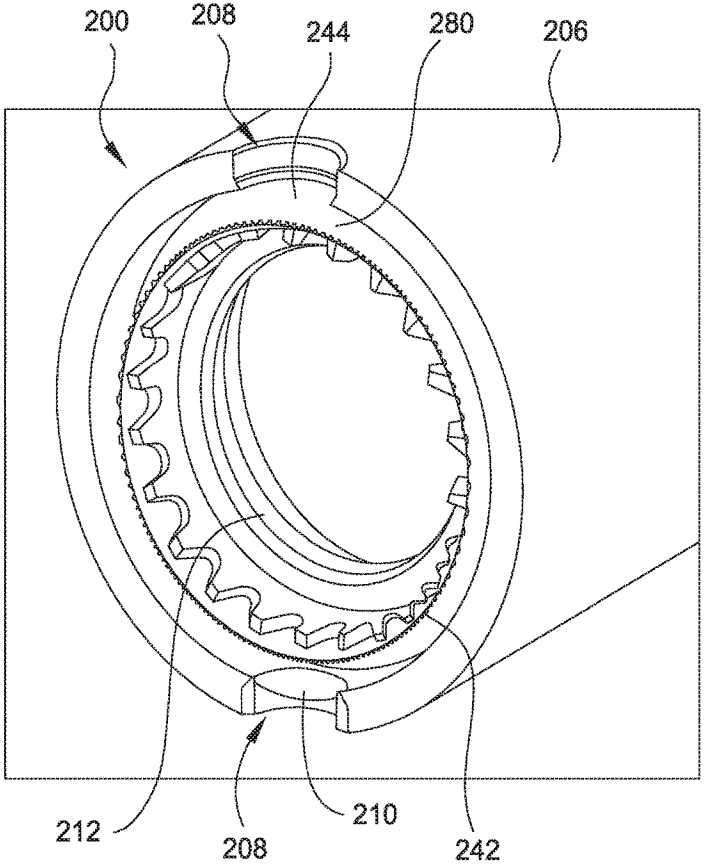
FIG. 6A is a perspective partial cross-sectional view of the casing string collar of FIG. 2A.
Figure 6C:
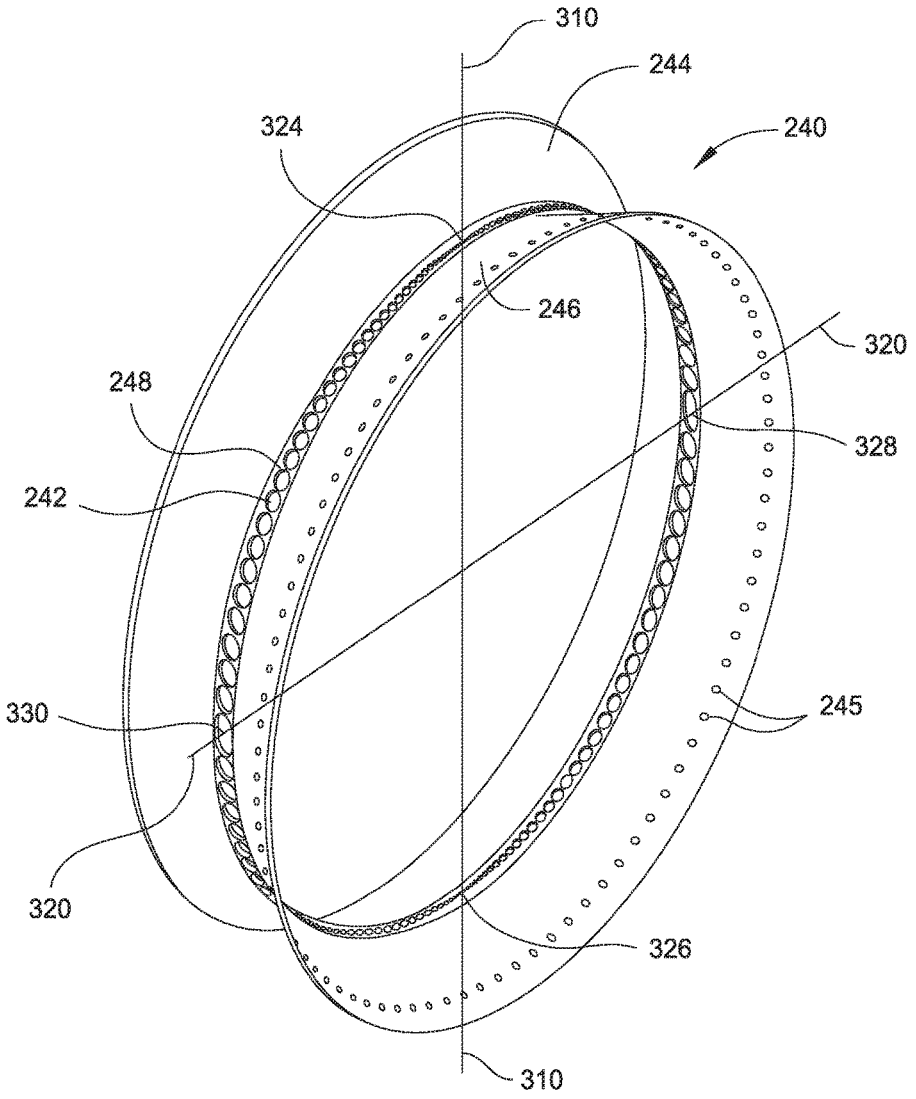
FIG. 6C is a perspective view of the baffle in the casing string collar of FIG. 2A.

The casing string collar 200 also includes a baffle 240 arranged between the body 206, the box sub 202, and the pin sub 204. The baffle 240 includes a first surface 248 arranged in a gap G between the box sub 202 and the pin sub 204. The baffle 240 includes a second surface 244 and a third surface 246 that are arranged at angles relative to the first surface 248. The second surface 244 of the baffle 240 can be supported by an angled surface 238 at a distal end 230 of the box sub 202. Similarly, the third surface 246 of the baffle 240 can be supported by an angled surface 239 at a proximal end 232 of the pin sub 204. FIG. 6A illustrates a cross-sectional perspective view of the baffle in the casing string collar and FIG. 6C illustrates a perspective view of the baffle 240. The baffle 240 includes a plurality of orifices 242 arranged on the first surface 248. In one embodiment, the orifices 242 vary in size from a smallest orifice at or proximate to locations on the first surface 248 aligned with a first axis 310 to a largest orifice at or proximate to locations on the first surface 248 aligned with a second axis 320. Put differently, smallest orifices are arranged at or proximate to the lead lines for reference numbers 324 and 326 and largest orifices are arranged at or proximate to the lead lines for reference numbers 328 and 330. The orifices 242 increase in size from the smallest orifices at reference numbers 324 and 326 toward the largest orifices at reference numbers 328 and 330. The size of the orifices 242 may increase linearly or in another manner. In various embodiments, a total cross-sectional area of the orifices 242 is equal to or greater than the cross-sectional area of one of the ports 208. In various other embodiments, the total cross-sectional area of the orifices 242 is less than the cross-sectional area of one of the ports 208.

Referring again to FIGS. 2A and 2B, cement slurry travels from an interior volume 201 of the casing string collar 200, through the orifices 242 in the baffle 240, and into a ring-shaped volume 280. In various embodiments, a cross-sectional area of the ring-shaped volume 280 is equal to at least half of the cross-sectional area of one of the ports 208. The cement slurry travels circumferentially through the ring-shaped volume 280 to reach the port 208 with the burst rupture disc 210. The cement slurry will encounter less flow resistance through the larger orifices 242 than the smaller orifices 242. FIG. 6B is a cross-sectional end view of the casing string collar and includes arrows 350, 360, wherein larger arrows indicate less flow resistance of the orifice 242 in the baffle 240. Thus, the cement slurry flows more readily through the orifices 242 indicated by the larger arrows 350 than through the smaller arrows 360. By arranging (i.e., clocking) the baffle 240 relative to the ports 208 such that the smallest orifices 242 (at the locations of reference numbers 324 and 326 in FIG. 6C) are aligned with the ports 208, a total flow resistance through the orifices 242, through the ring-shaped volume 280, and through the port 208 can be substantially similar at different circumferential locations around the first surface 248 of the baffle 242. For example, at a circumferential location proximate to the port 208 (e.g., at the location indicated by reference number 324), cement slurry does not have far to travel through the ring-shaped volume 280 to reach the port 208 with the burst rupture disk 210, so the resistance to flow of the cement slurry through the ring-shaped volume 280 and the port 208 is relatively low. Accordingly, orifices 242 at the circumferential location are small and the resistance to flow of cement slurry through the orifices 242 is relatively high. As another example, at a circumferential location oriented ninety degrees away from the port 208 with the burst rupture disk 210 (e.g., at the location indicated by reference number 328), cement slurry travels a relatively long distance through the ring-shaped volume 280 to reach the port 208. As a result, the resistance to flow of the cement slurry through the ring-shaped volume 280 to reach the port 208 is relatively high. Accordingly, the orifices 242 at the circumferential location oriented ninety degrees from the port 208 with the burst rupture disk 210 are large such that the resistance to flow of cement slurry through the orifices 242 is relatively low. The orifices 242 in the baffle 240 can be sized and arranged such that total resistance to flow of the cement slurry through an orifice at a circumferential position, flow through the ring-shaped volume 280 to the port 208, and flow through the port 208 is substantially equal to the total resistance through remaining orifices 242. As a result, the flow of cement slurry may be substantially evenly distributed about the circumference of the gap G between the distal end 230 of the box sub 202 in the proximal end 232 of the pin sub 204 can be achieved.

The evenly-distributed flow of cement slurry about the circumference of the gap G reduces the amount of erosion that may occur to the portions of the distal end 230 of the box sub 202 and the proximal end 232 of the pin sub 204 that are exposed to flow of the cement slurry. In particular, erosion of sealing surface 234 and 236 (discussed in greater detail below) on the distal end 230 of the box sub 202 and the proximal end 232 of the pin sub 204, respectively, can be reduced. In use, the baffle 240 is placed within the body 206 and the box sub 202 of the pin sub 204 are screwed into (i.e., made up) the body 206. Thereafter, before the ruptured discs 210 are installed in the ports 208, the baffle 240 can be rotated (i.e., clocked) to align the smallest orifices with the ports 208. Once the baffle 240 is properly aligned, a pin 250 can be inserted into an aperture 245 in the third surface 246 and into a hole 247 in the angled surface 239 at the proximal end 232 of the pin sub 204. The pin 250 prevents the baffle 240 from rotating relative to the body 206, the box sub 202, or the pin sub 204. The third surface 246 can include a plurality of apertures 245 to enable a closest alignment to be selected. In various embodiments, the second surface 244 can include another plurality of apertures, and a second pin 250 could be inserted into one of the apertures in the second surface 244 and into a hole in the angled surface 238 at the distal end 230 of the box sub 202. In various embodiments, more than one pin 250 could be inserted through the third surface 246. For example, a first pin 250 could be inserted through a first aperture 245 via a first port 208 and a second pin 250 could be inserted through a second aperture 245 via a second port 208. As another example, a third pin could be inserted through a third aperture in the second surface 244 and a fourth pin could be inserted through a fourth aperture in the second surface 244.

In various embodiments, the orifices 242 in the baffle 240 can have circular profiles, oval profiles, rectangular profiles, or profiles having other shapes. In various embodiments, the sizes of the orifices 242 can vary linearly or non-linearly. In various embodiments, the sizes of the orifices 242 can change in a step-wise manner, meaning there can be a series of orifices of a first size, then a series of orifices of a second size, then a series of orifices of a third size, and so on.

Figure 1A:
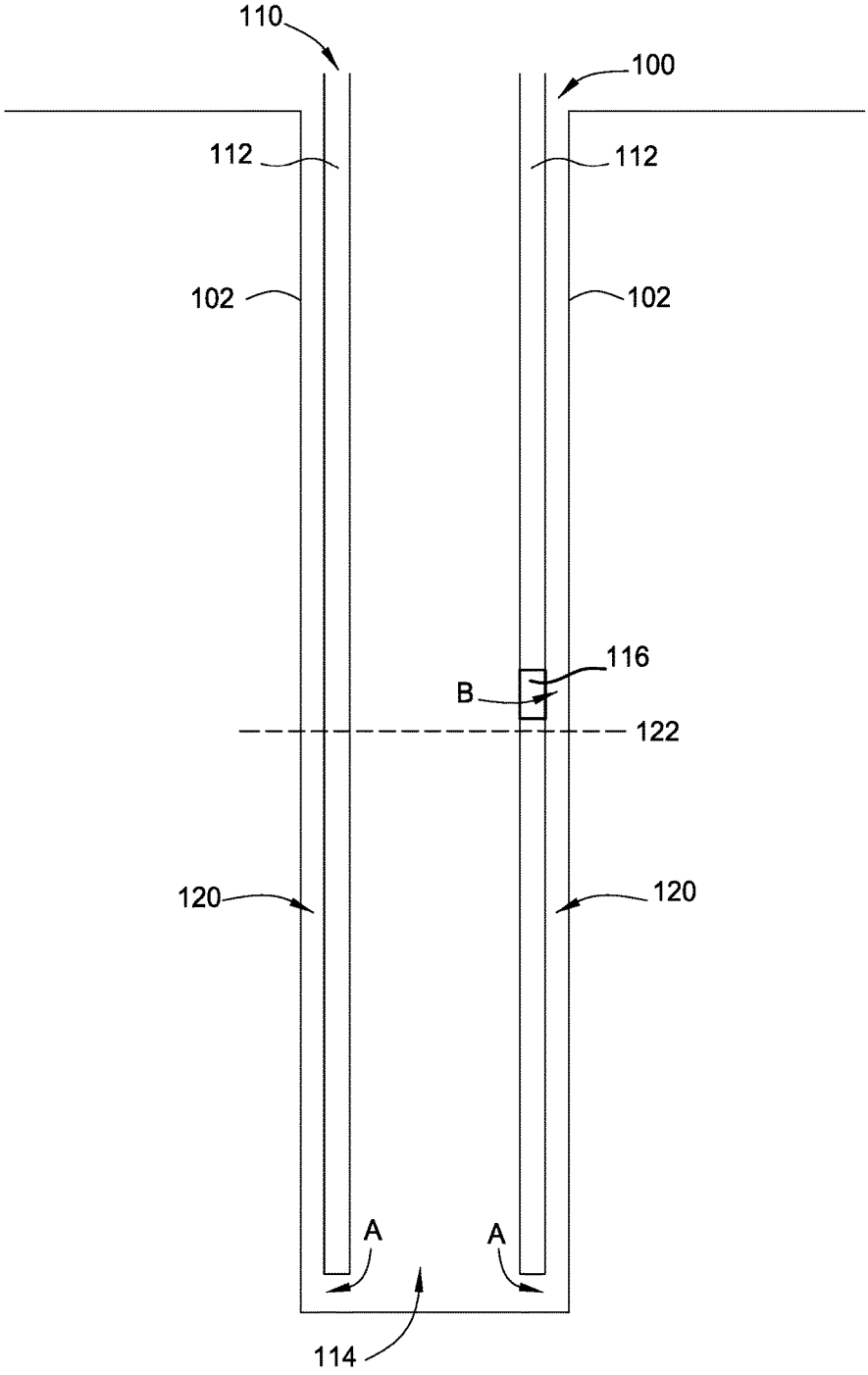
FIG. 1A is a cross-sectional schematic side view of a casing string in a wellbore in which a cement slurry can flow out of an opening at a bottom of the casing string and then out of a port along a side of the casing string.
Figure 1B:
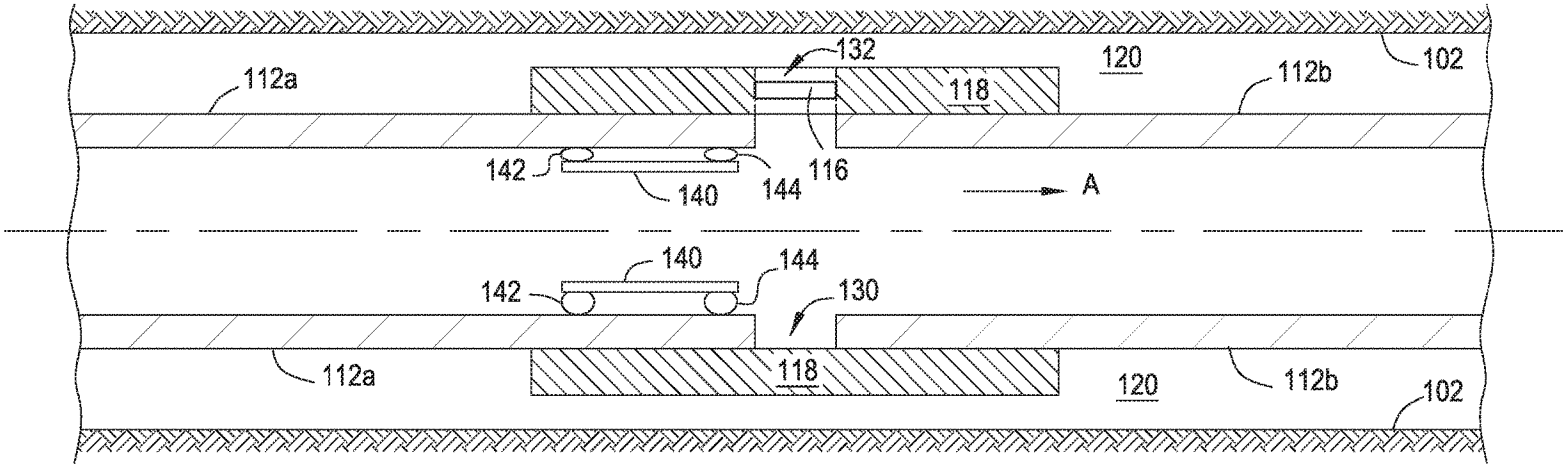
FIG. 1B is a cross-sectional schematic side view of a casing string in a wellbore in which a cement slurry flows past a port along a side of a casing string because the port is blocked by a rupture disc.
Figure 1C:
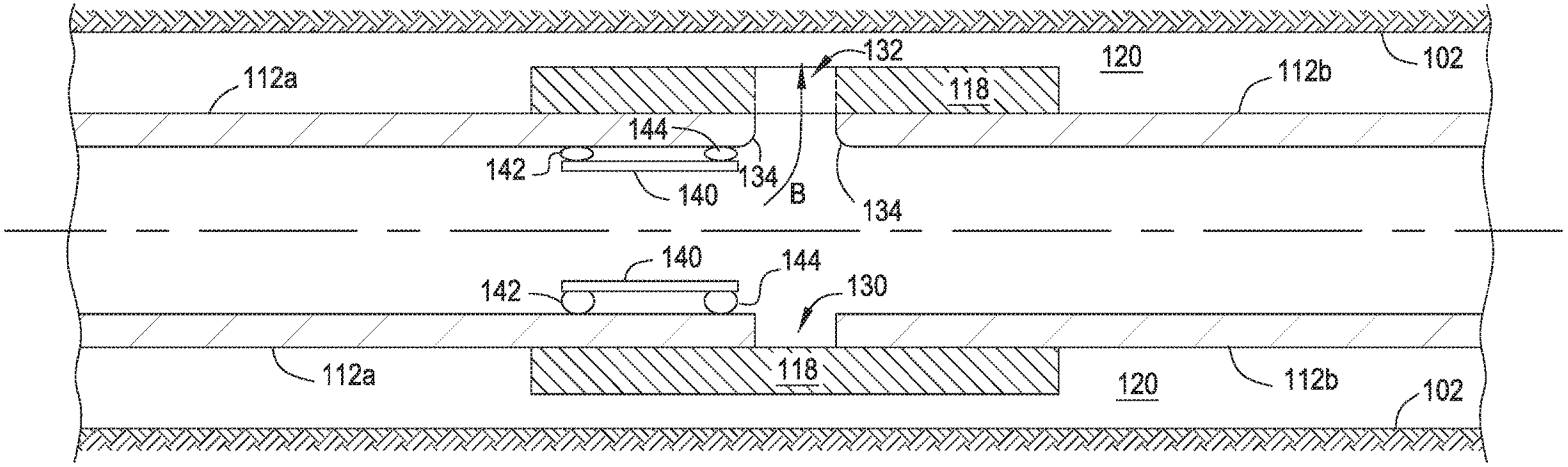
FIG. 1C is a cross-sectional schematic side view of the casing string of FIG. 1B in the wellbore in which the cement slurry flows through the port along the side of the casing string because the rupture disc has burst.
Figure 1D:
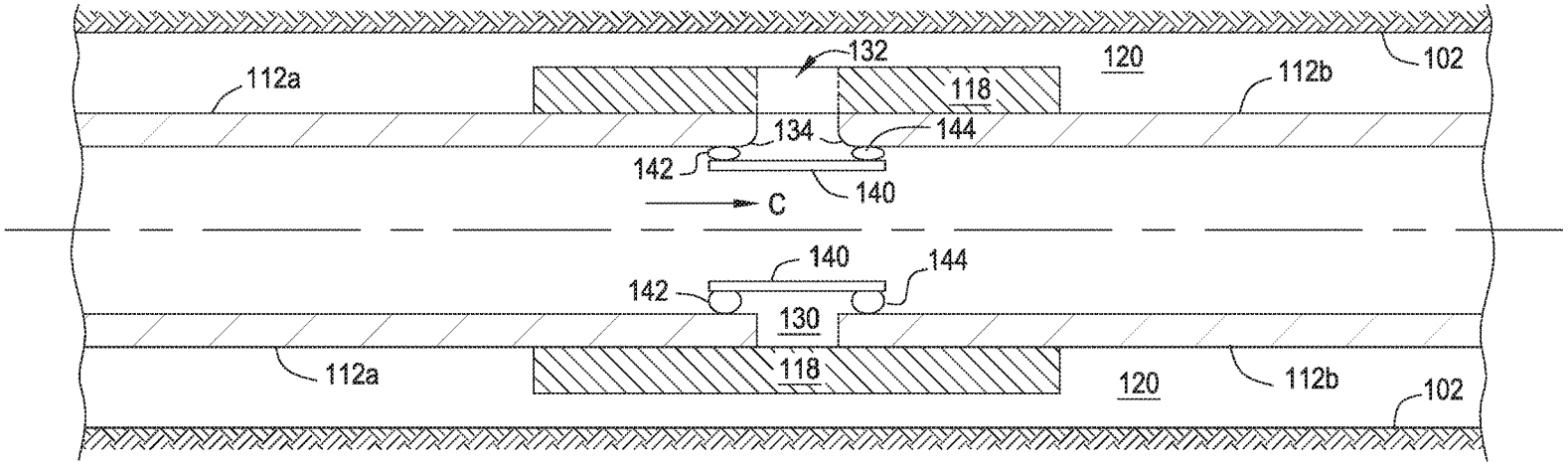
FIG. 1D is a cross-sectional schematic side view of the casing string of FIG. 1B in the wellbore in which the port has been sealed off by a sealing sleeve.

Referring again to FIGS. 2A and 2B, as discussed above with reference to FIG. 1A, cement slurry can first be pumped in the direction of arrow A past the casing sting collar 200 to a distal port along a casing string to which the casing string collar 200 is attached. For example, the cement slurry could be pumped through apertures in a shoe at a distal end of the casing string. As another example, the cement slurry could be pumped through a port 208 of another casing string section 200 located at a more-distal location in the casing string. Initially, the ring-shaped volume 280 can be packed with grease or the like to discourage or reduce the amount of cement slurry that prematurely enters the volume 280. After the annular gap of the portions of the casing string that are more distal than the subject casing string collar 200 have been filled, a plug can be sent through the casing string (passing through the casing string collar 200) to block further flow of cement slurry through the downstream apertures or ports. After the downstream ports or apertures are plugged, hydrostatic and/or applied pressure of drilling fluid, cement slurry, or other fluid in the interior volume 201 of the casing string section 200 can be increased to cause one of the rupture discs 210 to burst. Cement slurry can then pass through the orifices 242 in the baffle 240, through the ring-shaped volume 280, and out of the port 208, as described above.

Figure 3A:
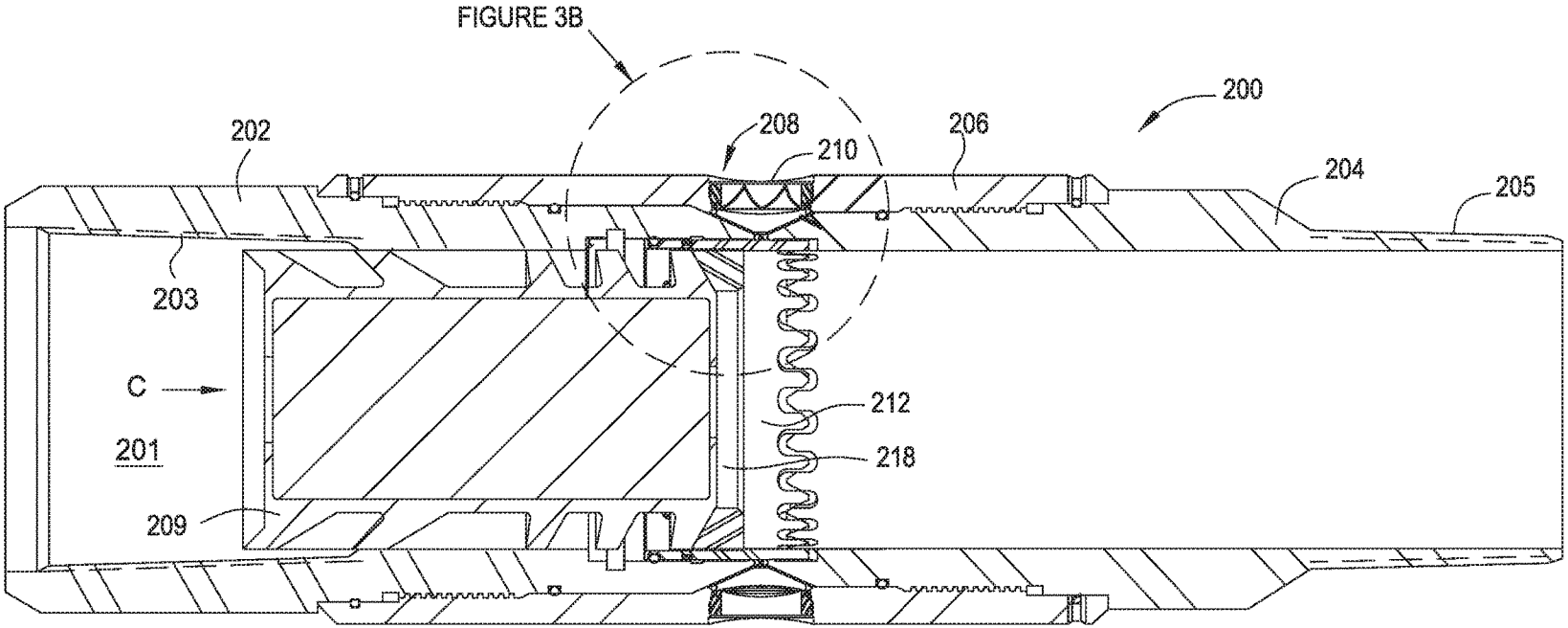
FIG. 3A is a cross-sectional side view of the casing string collar of FIG. 2A in which the sealing sleeve has moved to a position just before a sealing position.
Figure 3B:
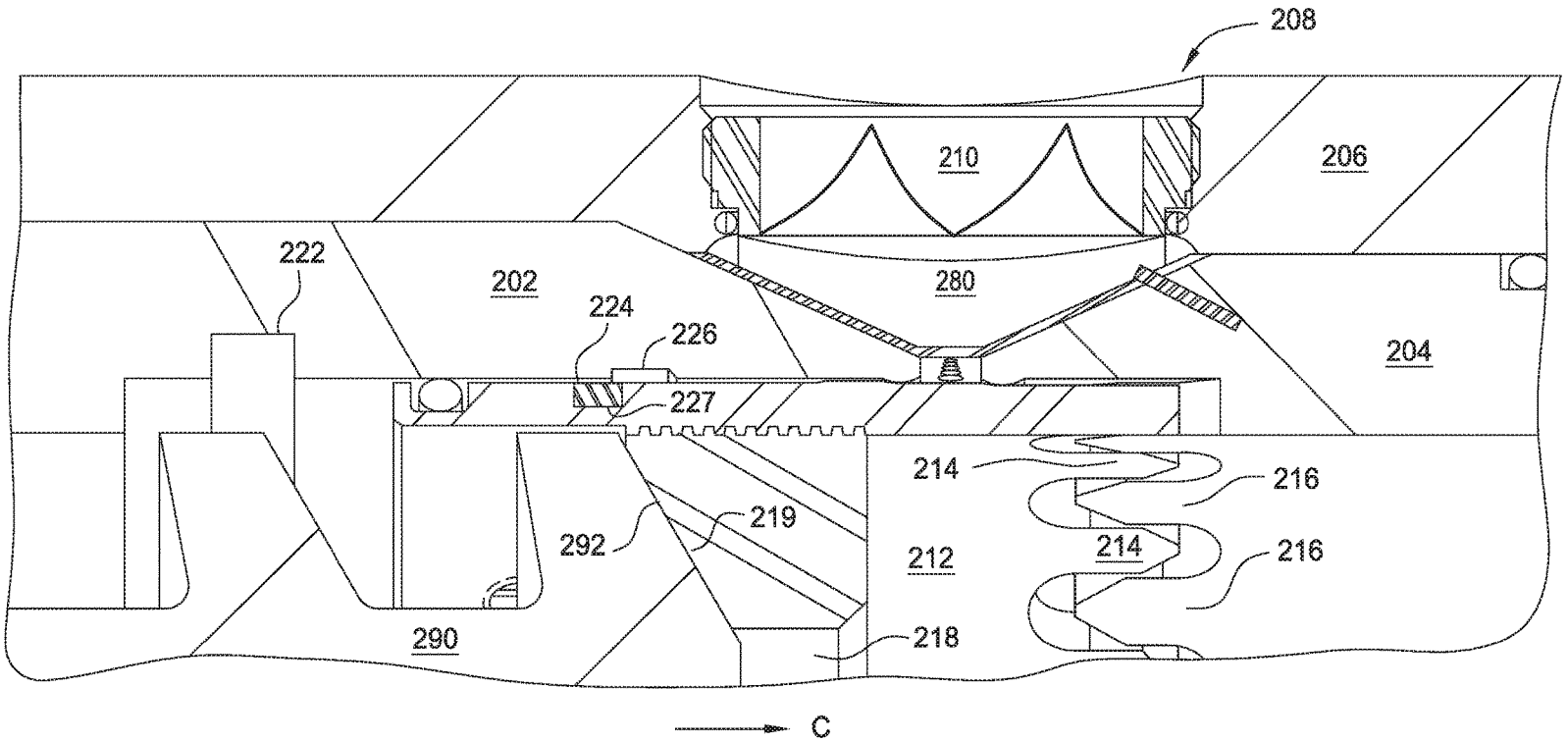
FIG. 3B is a first cross-sectional detail side view of the casing string collar of FIG. 3A.

After a desired and/or allowable amount of cement slurry has been pumped through the port 208 to fill at least some of a remaining portion of the annulus (e.g., annulus 120 shown in FIG. 1A above the dashed line 122), the sealing sleeve 212 can be moved to isolate the port 208 from the interior volume 201 of the casing string collar 200. Referring to FIGS. 3A and 3B, a plug or dart 290 can be sent down the casing string. The plug or dart 290 includes a distal surface 292 that can push against a mating surface 219 of the plug seat 218. A force exerted by the plug or dart 290 against the plug seat 218 can shear the shear screws 220, thereby freeing the sealing sleeve 212 to move in the direction of arrow C. As shown in FIGS. 3A and 3B, the anti-rotation fingers 214 of the sealing sleeve 212 engage the anti-rotation fingers 216 in the pin sub 204. As discussed above, sealing sleeve 212 may rotate, if necessary, for the anti-rotation fingers 214 and 216 to align. Once the mating surfaces 213 and 221 of the anti-rotation fingers 214 and 216, respectively, begin to overlap (as shown in FIGS. 3A and 3B), the anti-rotation fingers 214 and 216 are aligned and the sealing sleeve 212 will not rotate with respect to the box sub 202 or the pin sub 204.

Figure 3C:
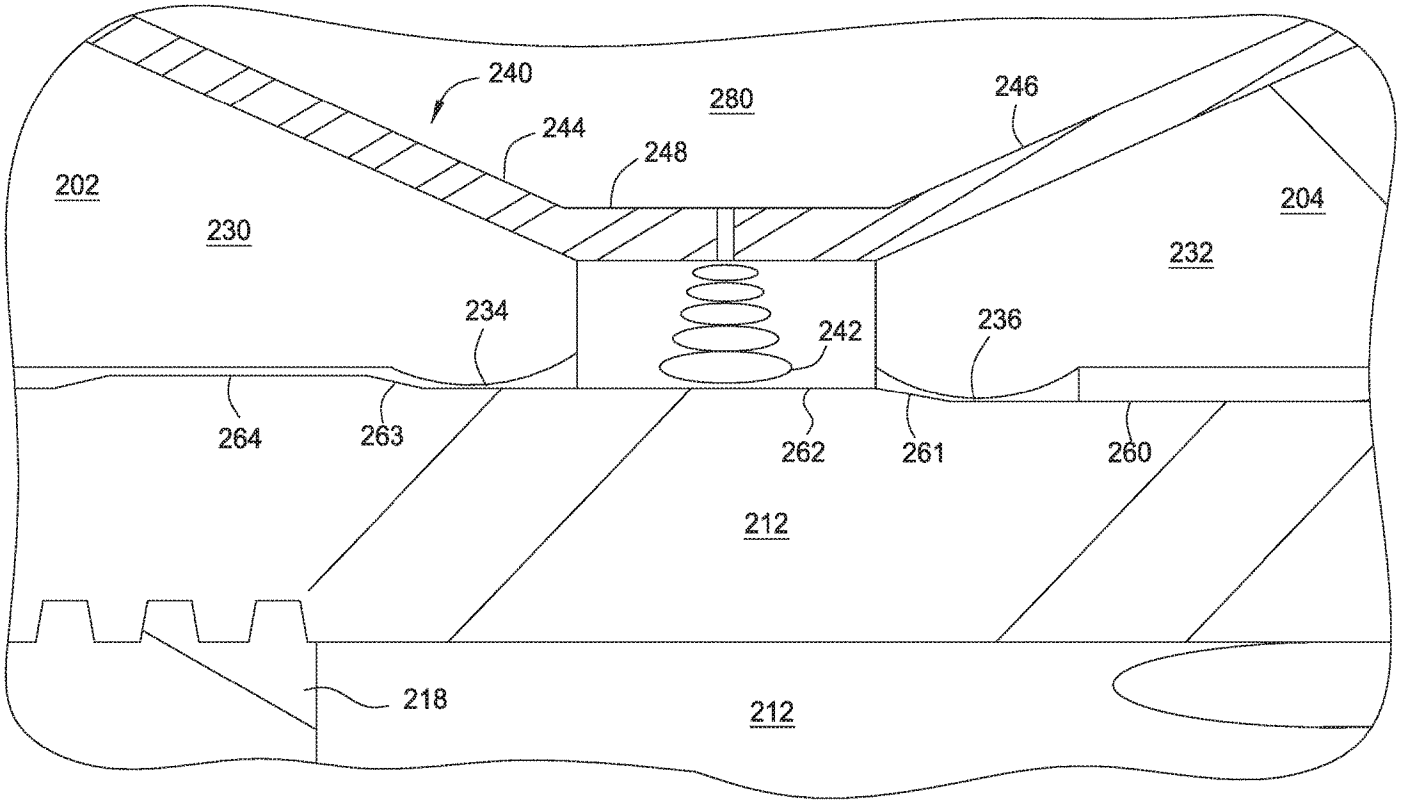
FIG. 3C is a second cross-sectional detail side view of the casing string collar of FIG. 3A.

FIG. 3C illustrates a detail view of an exterior surface of the sealing sleeve 212, a sealing surface 234 on the box sub 202, and a sealing surface 236 on the pin sub 204 shown in FIGS. 3A and 3B. The sealing sleeve 212 includes a first portion 260 with an exterior wall having a first diameter, a second portion 262 having a second diameter that is larger than the first, and a third portion 264 having a third diameter that is larger than the second diameter. The sealing sleeve 212 can include a first transition portion 261 that transitions from the first diameter to the second diameter. The sealing sleeve can include a second transition portion 263 that transitions from the second diameter to the third diameter. The sealing surface 234 on the distal end 230 of the box sub 202 can be formed at a diameter such that it does not contact the surface of the central portion 262 of the sealing sleeve 212 and that has an interference fit with the surface of the third portion 264 of the sealing sleeve. Similarly, the sealing surface 236 on the proximal end 232 of the pin sub 204 can be formed at a diameter such that it does not contact the surface of the first portion 260 of the sealing sleeve 212 that has an interference fit with the surface of the second portion 262 of the sealing sleeve 212. In the position of the sealing sleeve 212 shown in FIGS. 3A-3C, the anti-rotation fingers 214 and 216 have aligned (because the mating surfaces 213 and 221 of the anti-rotation fingers 214 and 216 have begun to overlap), but the sealing surfaces 234 and 236 are not aligned with the third portion 264 and the second portion 262, respectively, of the sealing sleeve 212. As a result, the sealing surfaces 234 and 236 are not in contact with the sealing sleeve 212 when the sealing sleeve 212 may be rotating to align the anti-rotation fingers 214 and 216. Also, the sealing surfaces 234 and 236 are not in contact with the sealing sleeve 212 as the sealing sleeve 212 translated in the direction of arrow C to the position shown in FIGS. 3A-3C. Such contact between the sealing surfaces 234 and 236 and the sealing sleeve 212 while the sealing sleeve 212 is translating in the direction of arrow C or rotating to align the anti-rotation fingers 214 and 216 could cause erosion of the sealing surfaces 234 and 236 and/or erosion to surfaces of the sealing sleeve 212.

FIG. 3C shows that the sealing surface 234 on the distal end 230 of the box sub 202 is aligned with a location on the sealing sleeve 212 where the second portion 262 and the second transition portion 263 of the sealing sleeve 212 meet. FIG. 3C also shows that the sealing surface 236 on the proximal end 232 of the pin sub 204 is aligned with a location on the sealing sleeve 212 where the first portion and the first transition portion 261 of the sealing sleeve 212 meet.

Figure 4A:
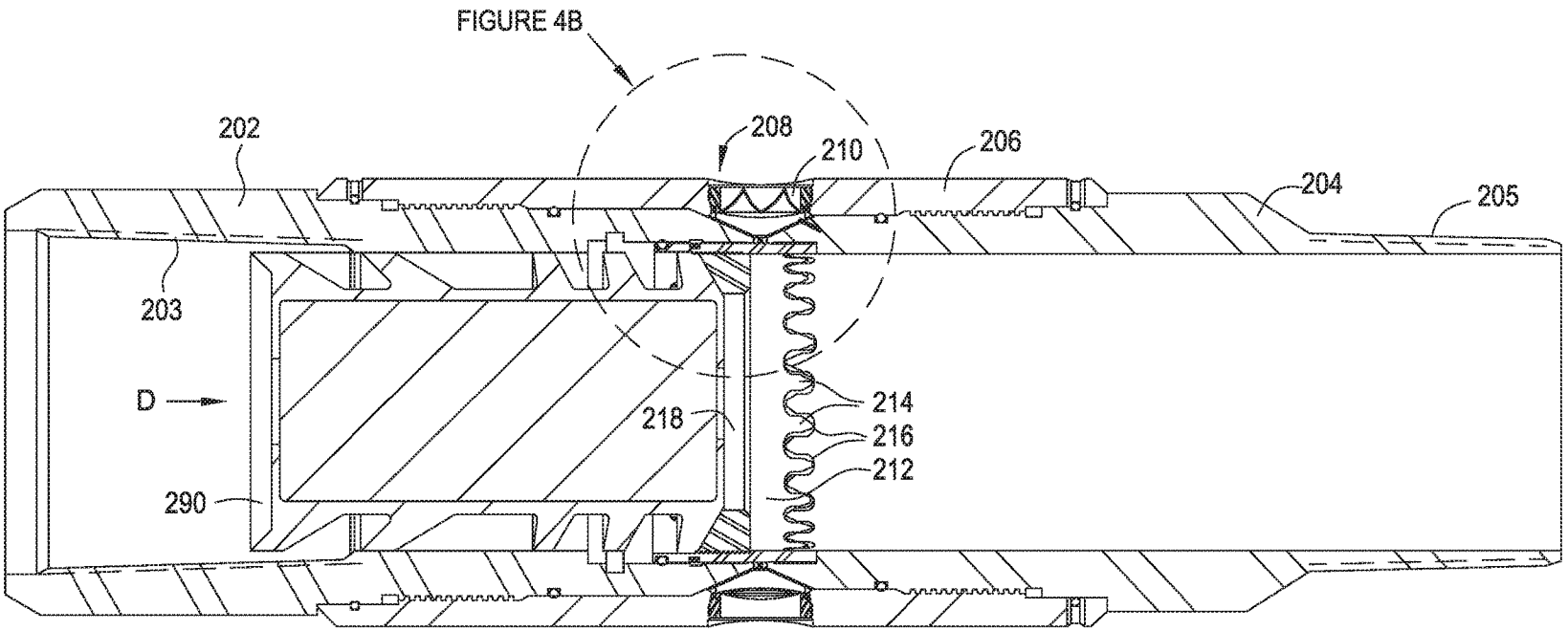
FIG. 4A is a cross-sectional side view of the casing string collar of FIG. 2A in which the sealing sleeve has moved to a sealed position.
Figure 4B:
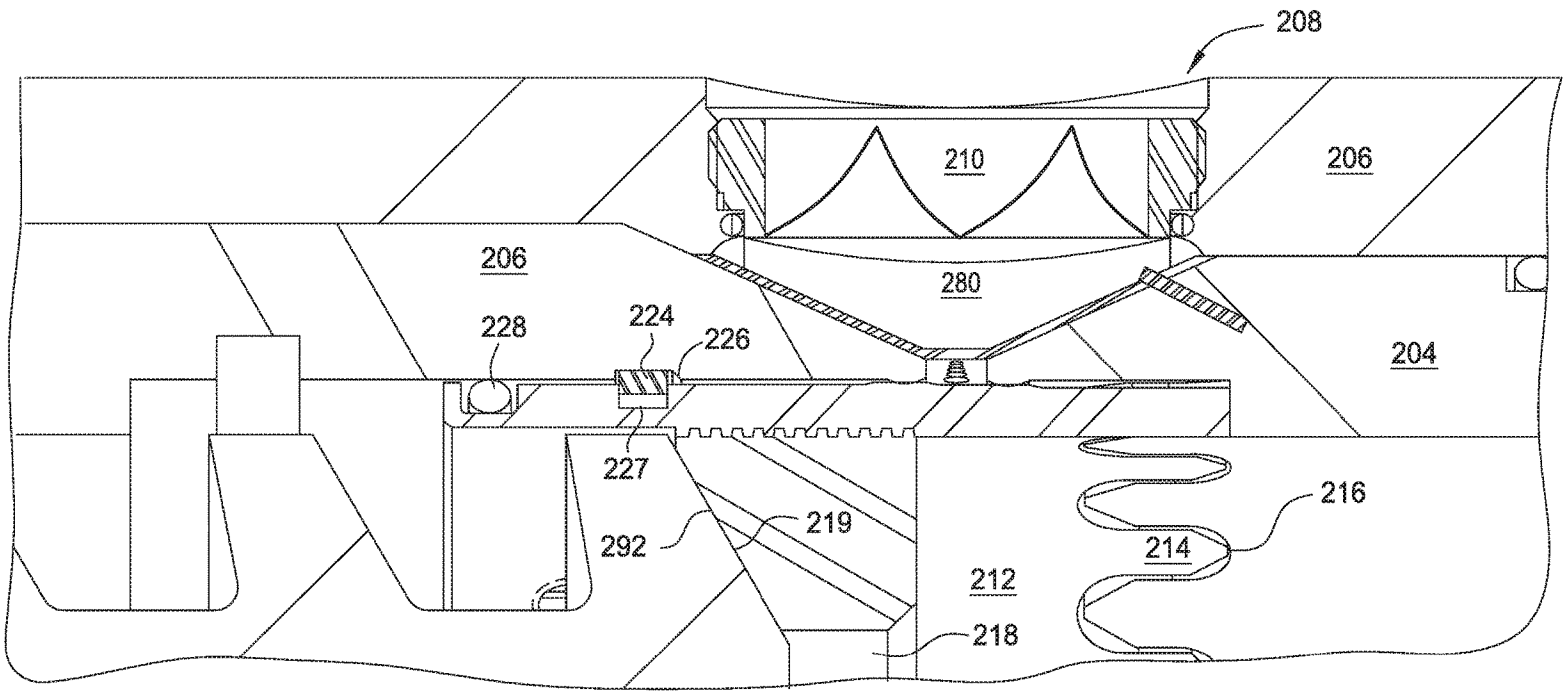
FIG. 4B is a first cross-sectional detail side view of the casing string collar of FIG. 4A.
Figure 4C:
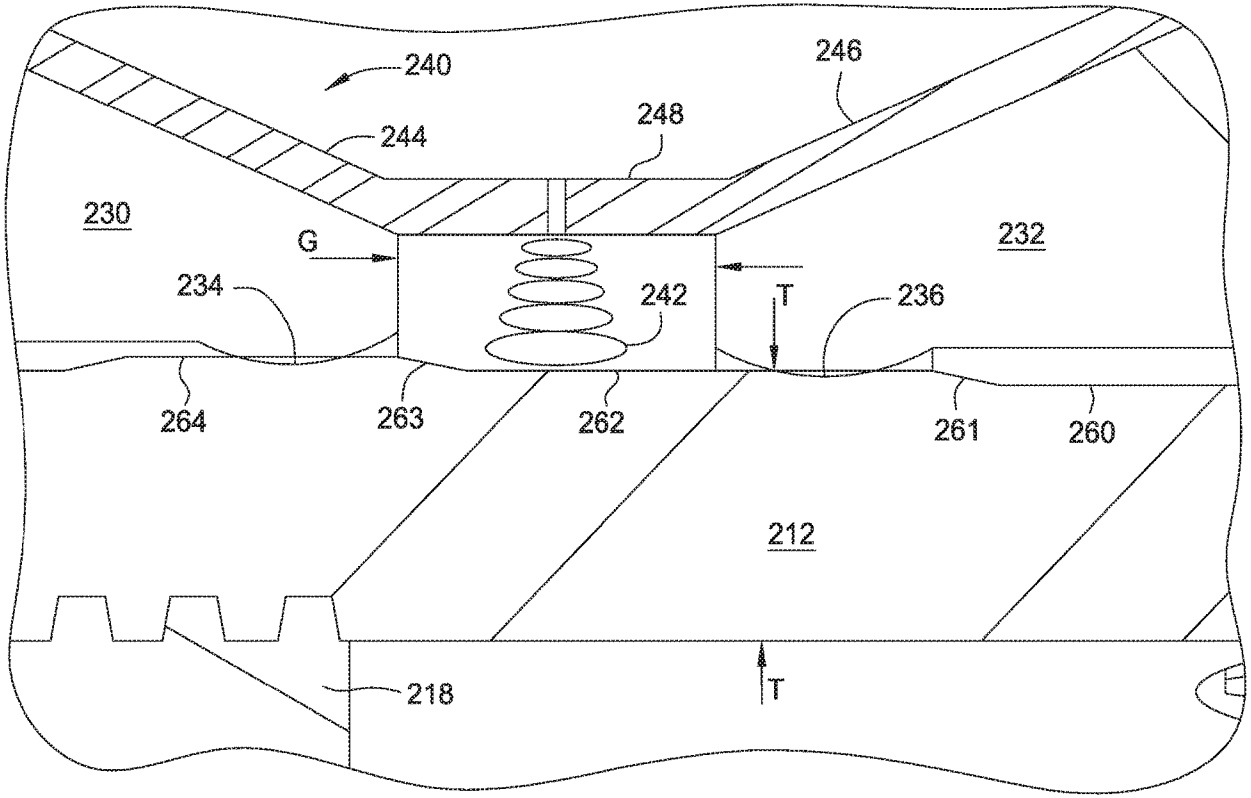
FIG. 4C is a second cross-sectional detail side view of the casing string collar of FIG. 4A.

FIGS. 4A-4C illustrate the casing string collar 200 after the dart 290 has pushed the sealing sleeve 212 the remaining distance of its travel in the direction of arrow D. The travel of the sealing sleeve 212 could be limited by the full engagement of the anti-rotation fingers 214 and 216. The travel of the sealing sleeve 212 could be limited by the snap ring 224 reaching the slot 226 formed in the box sub 202. Before the snap ring 224 reaches the slot 226 (as shown in FIGS. 3A-3C), the snap ring 224 is retained in the slot 227 formed in the sealing sleeve 212 by the interior walls of the box sub 202. When the sealing sleeve 212 travels in the direction of arrow D such that the snap ring 224 reaches the slot 226, the snap ring 224 expands radially outward into the slot 226. The slot 226 has a depth that is less than a depth of the snap ring 224 such that the snap ring 224 is in both the slot 226 formed in the box sub 202 and the slot 227 formed in the sealing sleeve 212. Thereafter, the expanded snap ring 224 prevents the sealing sleeve 212 from moving in a direction opposite of arrow D (shown in FIG. 4B) and could prevent the sealing sleeve 212 from moving further in the direction of arrow D.

Referring to FIG. 4C, the remaining distance of travel of the sealing sleeve 212 in the direction of arrow D causes the surface of the third portion 264 of the sealing sleeve 212 to contact the sealing surface 234 on the distal end 230 of the box sub 202 and causes the surface of the second portion 262 of the sealing sleeve 212 to contact the sealing surface 236 on the proximal end 232 of the pin sub 204. The first transition portion 261 and the second transition portion 263 enable the sealing surfaces 234 and 236 to gradually expand radially outward to accommodate the interference fits with the third portion 264 and the second portion 262 of the sealing sleeve 212 as the sealing sleeve 212 moves in the direction of arrow D. As described above, the third portion 264 of the sealing sleeve 212 and the sealing surface 234 can have an interference fit that results in a radially-inward load on the sealing sleeve 212 at the third portion 264 and a radially-outward load on the distal end 230 of the box sub 202 at the sealing surface 234. Similarly, the second portion 262 of the sealing sleeve 212 and the sealing surface 236 can have an interference fit that results in a radially-inward load on the sealing sleeve 212 at the second portion 262 and a radially-outward load on the proximal end 232 of the pin sub 204 at the sealing surface 236. The radially-inward loads and radially-outward loads on the sealing surfaces 234 and 236 and on the second and third portions 262 and 264 of the sealing sleeve 212 can ensure a tight metal-to-metal seal therebetween. In various embodiments, the radially-inward loads and radially-outward loads between the sealing sleeve 212 and the sealing surfaces 234 and 236 exceed a differential pressure of fluids trying to pass by the sealing surfaces 234 and 236, thereby maintaining the metal-to-metal seals formed by the sealing sleeve 212 and the sealing surfaces 234 and 236 in the presence of such pressurized fluids. While the interference fits are beneficial for sealing, any relative motion between the sealing sleeve 212 and the sealing surfaces 234 and 236 after the interference fits are formed could cause erosion to the sealing surfaces 234 and 236 and/or to the second and third portions 262 and 264 of the sealing sleeve 212. Such erosion could result in leaks past the sealing sleeve 212. Comparing FIG. 3C to FIG. 4C, the amount of relative motion between the sealing surfaces 234 and 236 and the sealing sleeve 212 is minimized by only forming the above-described interference fits after the sealing sleeve 212 has completed any rotation due to alignment of the anti-rotation fingers 214 and 216. Also, the amount of relative motion is minimized by only forming the interference fits during the last portion of travel of the sealing sleeve 212.

After the metal-to-metal seals have been formed between the sealing surfaces 234 and 236 and the sealing sleeve 212, the port 208 is isolated from the interior volume 201 of the casing string collar 200. The metal-to-metal seals provide a more-durable seal than seals made of elastomeric materials. For example, a rubber or plastic seal may degrade over time in the presence of drilling fluid, oil, and/or natural gas that may be present in the interior volume 201 of the casing string collar 200.

Referring to FIG. 4C, in various embodiments, the gap G between the box sub 202 and the pin sub 204 can be equal to one-half to one-and-a-half times a wall thickness T of the sealing sleeve 212. For example, in an exemplary embodiment, the sealing sleeve 212 could have a wall thickness T of 0.5 inches and the gap G could be between 0.25 inches and 0.75 inches. In various other embodiments, the gap G could be less than a radius dimension of the port 208.

Figure 5A:
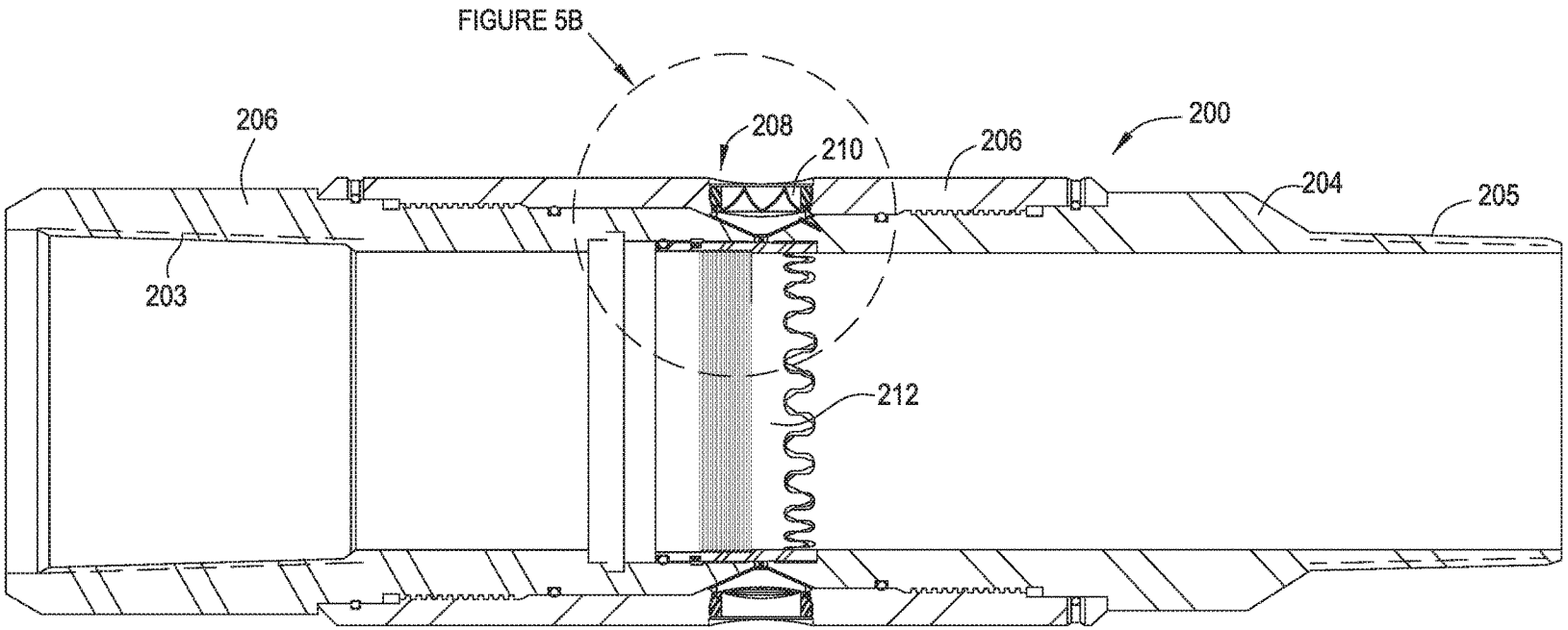
FIG. 5A is a cross-sectional side view of the casing string collar of FIG. 4A after a plug seal on the sealing sleeve has been drilled out.
Figure 5B:
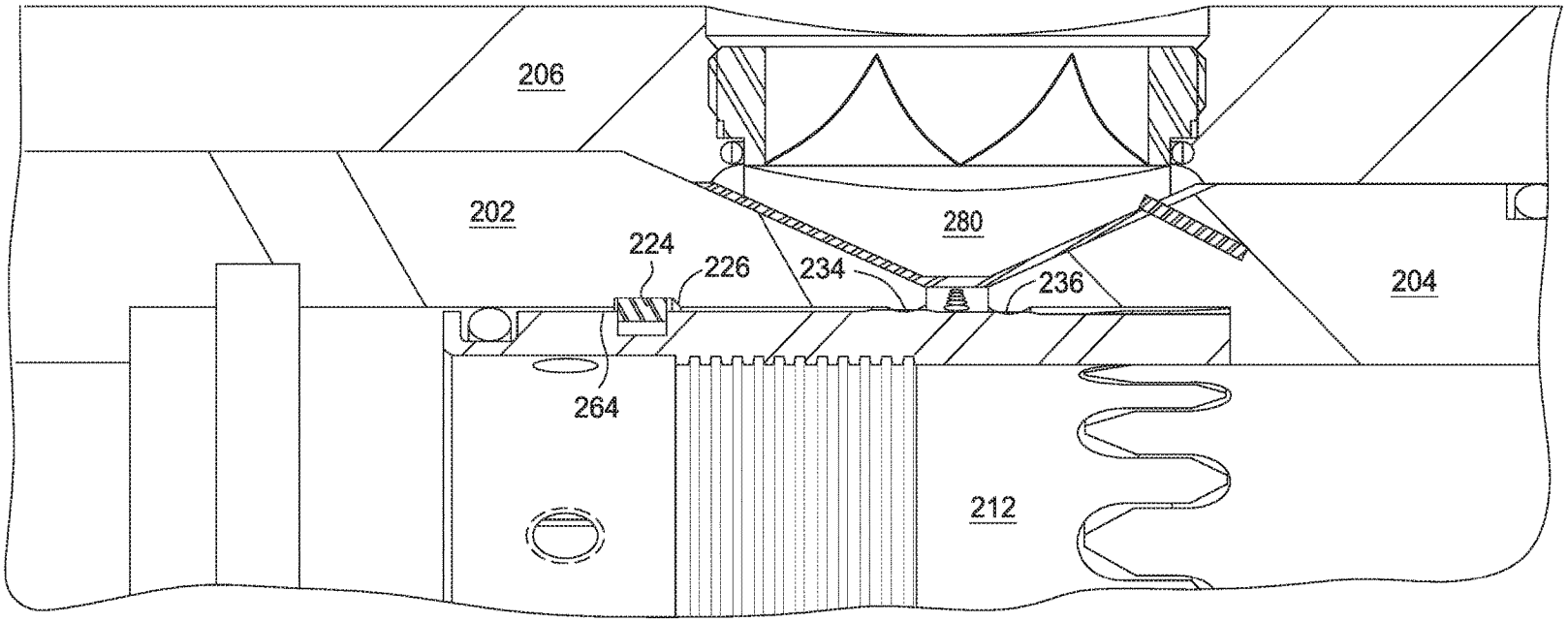
FIG. 5B is a cross-sectional detail view of the casing string collar of FIG. 5A.

Referring to FIGS. 5A and 5B, after the metal to metal seals have been made, a drill bit can drill out the plug or dart 290 and the plug seat 218. FIGS. 5A and 5B illustrate the casing string collar 200 after the plug or dart 290 and the plug seat 218 have been drilled out. Thereafter, additional drilling and/or well production operations can be performed at the bottom of the casing section.

Referring again to FIGS. 6A-6C, in instances in which the casing string collar 200 includes two ports 208 arranged 180° apart from one another, the arrangement of the above-described baffle 240 still may result in an even distribution of flow of cement slurry about the circumference of the gap G (shown in FIGS. 2A and 2B). As discussed above, in instances in which the ports 208 are arranged 180° apart from one another, the orifices 242 in the baffle 240 include smallest orifices that are arranged 180° apart from each other (proximate to the leading lines for reference numbers 324 and 326 in FIG. 6C) and that are aligned with the ports 208. The largest orifices are arranged 90° from the smallest orifices (proximate to the leading lines for reference numbers 328 and 330). As discussed above, when one of the rupture discs 210 in the ports 208 bursts, cement slurry will flow through the orifices 242 in the baffle 240, through the ring-shaped volume 280, and through the port 208 with the burst rupture disc 210. However, as discussed above, only one of the two rupture discs 210 will burst. For example, in FIG. 6B, if the top rupture disc 210 bursts, then the bottom rupture disc 210 will not burst. As a consequence, cement slurry proximate to the bottom port 208 and the rupture disc 210 that did not burst must travel through relatively small orifices (with a relatively high resistance to flow of cement slurry) and through a relatively long length of the ring-shaped volume 280 to reach the top port 208 with the burst rupture disc 210. Consequently, the total resistance to flow of cement slurry through the orifices 242 below the axis 320 will be higher than the total resistance through the orifices 242 above the axis 320. As a result, more of the cement slurry will likely flow out of the orifices 242 above the axis 320 then below the axis 320, which could lead to uneven erosion of the sealing surfaces 234 and 236.

Figure 7A:
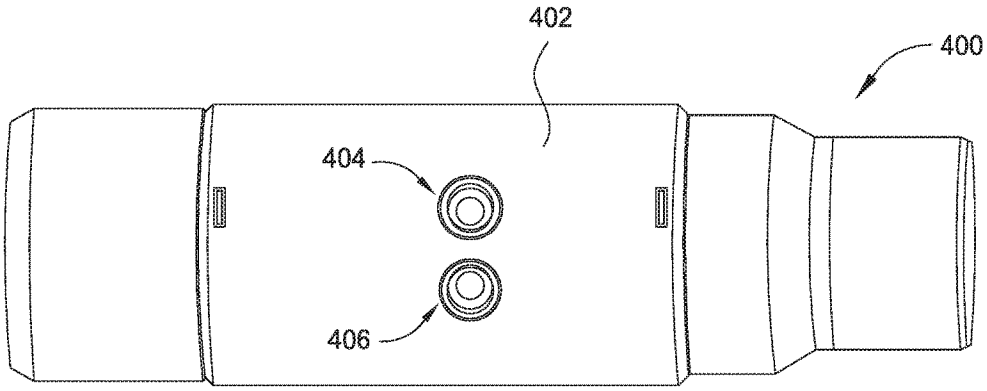
FIG. 7A is a top view of a casing string collar according to various embodiments.
Figure 7B:
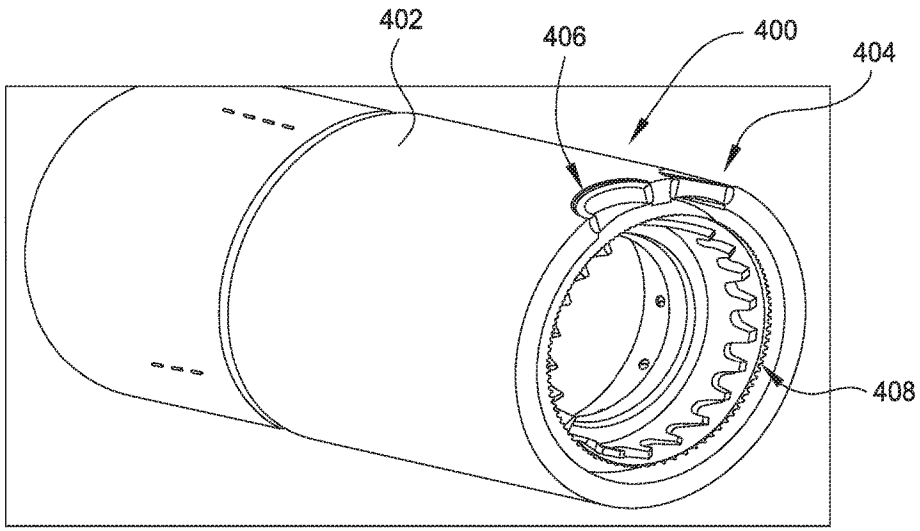
FIG. 7B is a perspective partial cross-sectional view of the casing string collar FIG. 7A.
Figure 7C:
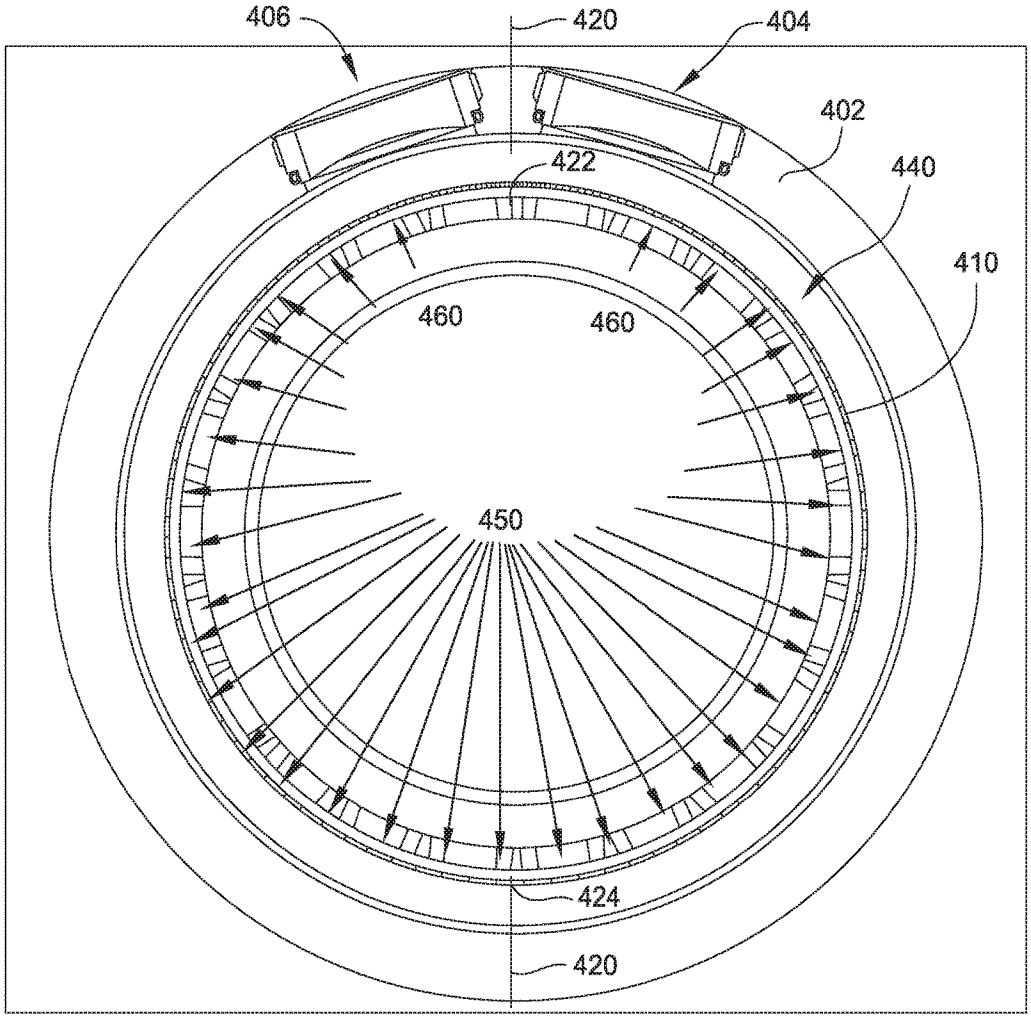
FIG. 7C is a cross-sectional end view of the casing string collar of FIG. 7A, wherein arrows represent flow of cement slurry through orifices of the baffle, and wherein lengths of the arrows represent relative amounts of flow through the orifices in the baffle.
Figure 7D:
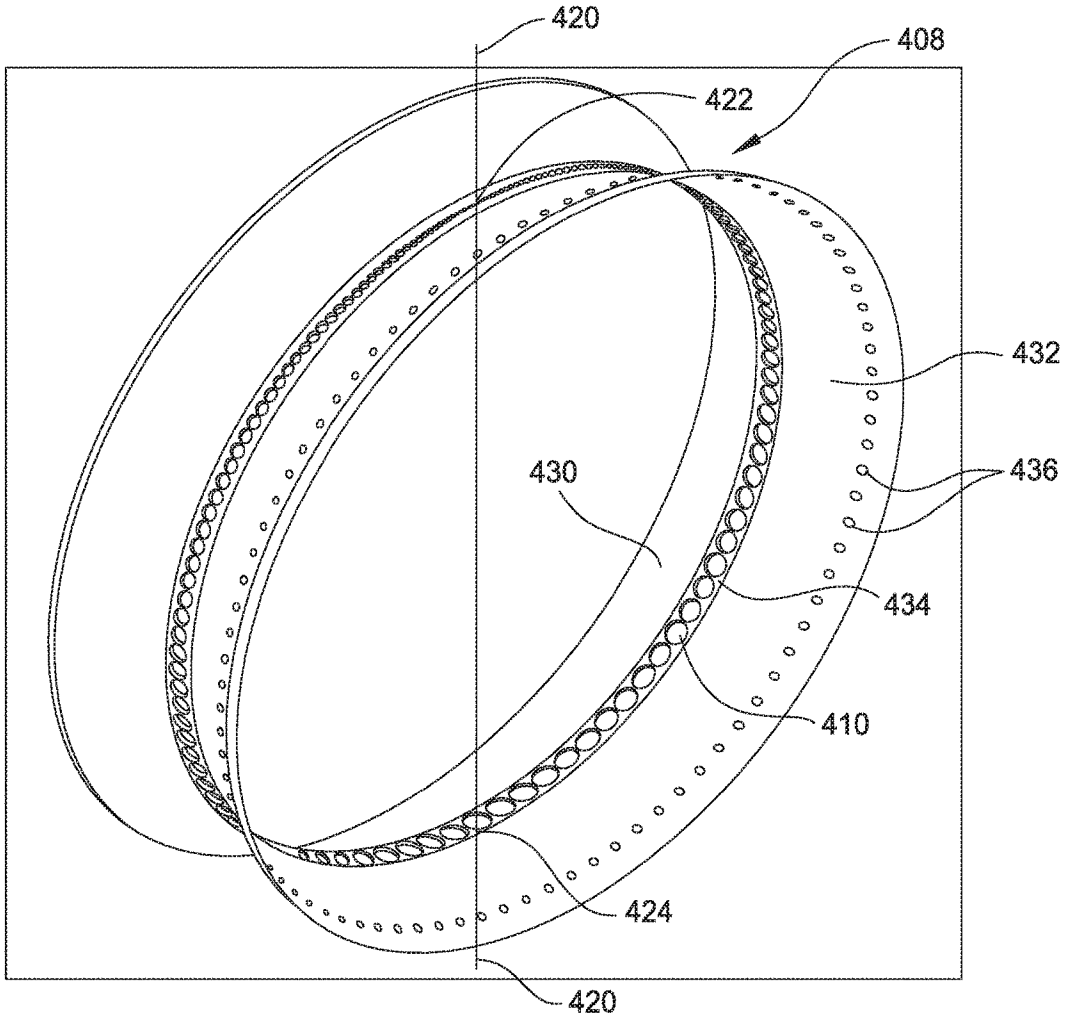
FIG. 7D is a perspective view of the baffle in the casing string collar of FIG. 7A.

FIGS. 7A-7D illustrate another embodiment of a casing string collar 400 in which two ports 404 and 406 are closely spaced on the body 402 of the casing string collar 400. For example, in various embodiments, the two ports 404 and 406 could be spaced between 15° and 60° apart. In various embodiments, the ports 404 and 406 could be spaced between 30° and 45° apart. Referring primarily to FIG. 7D, a baffle 408 for use with the casing string collar 400 can include orifices 410 arranged around a circumference of the first surface 434. The baffle 408 can include a second surface 430 and the third surface 432. The third surface 432 can include a series of apertures 436 that can receive a pin (e.g., pin 250 shown in FIGS. 2A and 2B). FIG. 7D illustrates an axis 420. The orifices 410 include a smallest orifice at or proximate to the axis 420 (proximate to the leading line for reference number 422). The orifices also include a largest orifice at or proximate to the axis 420 and spaced 180° apart from the smallest orifice (proximate to the leading line for reference number 424). Referring primarily to FIG. 7C, the baffle 408 can be aligned (i.e., clocked) so that the smallest orifice (at the leading line for reference number 422) is located between the two ports 404 and 406. In various embodiments, the smallest orifice is equally spaced from the two ports 404 and 406.

In the embodiment shown in FIGS. 7A-7D, regardless of whether a rupture disc in port 406 bursts or a rupture disc in port 404 bursts, the total resistance to flow of cement slurry can be approximately equal about the entire circumference of the first surface 434 of the baffle 408 that includes the orifices. As shown in FIG. 7C, the largest orifice (proximate to the leading line for reference number 424) is approximately 180° away from the ports 404 and 406. Thus, cement slurry passing through the largest orifice (with a relatively low resistance to flow of cement slurry, as indicated by large arrow 450) will travel a relatively long distance through a ring-shaped volume 440 to reach the port with the burst rupture disc. Similarly, cement slurry passing through the smallest orifice (with a relatively large resistance to flow of cement slurry, as indicated by small arrows 460) will travel a relatively short distance through the ring-shaped volume 440 to reach the port with the burst rupture disc.

Figure 8A:
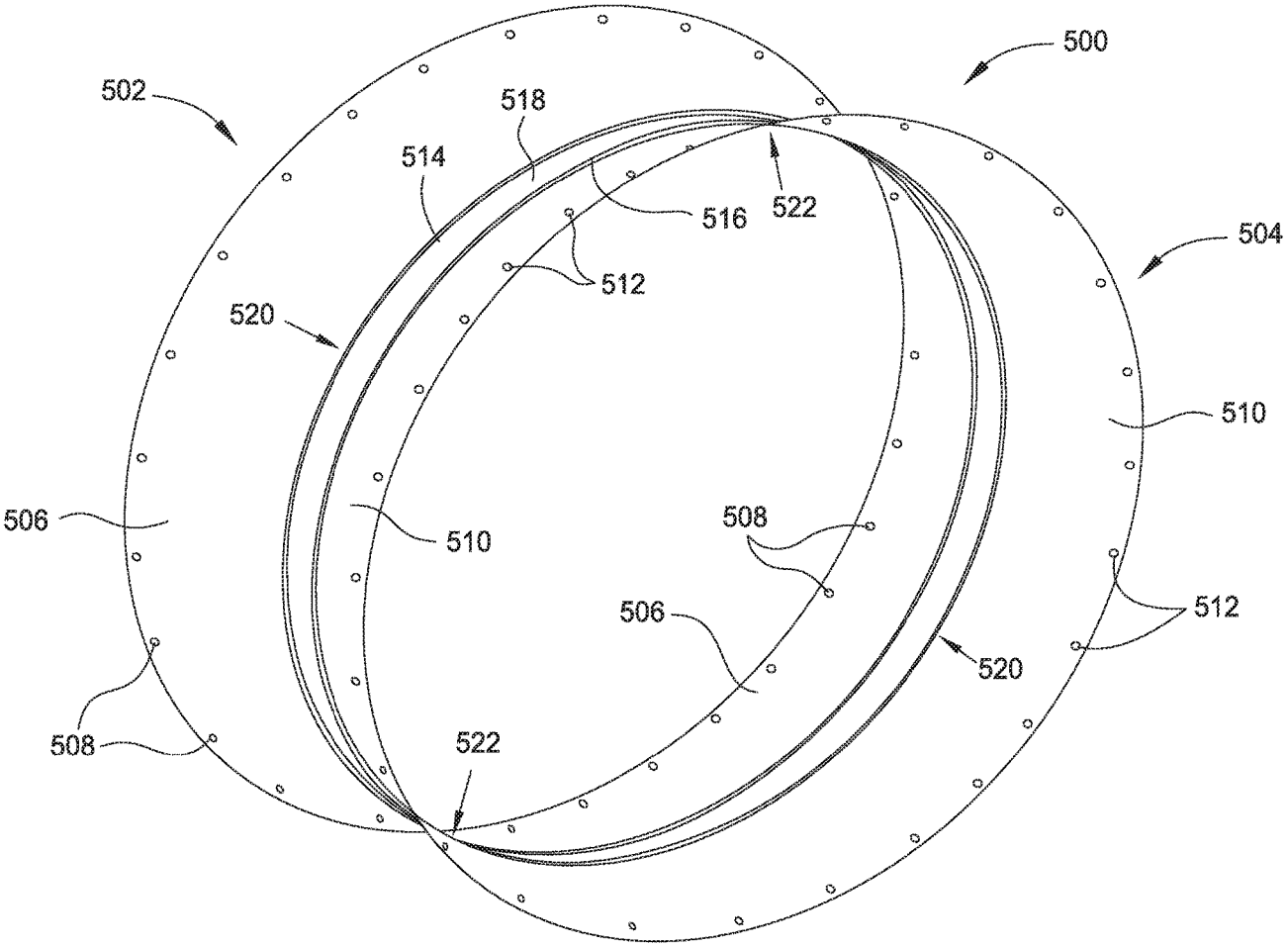
FIG. 8A is a perspective view of a baffle according to various embodiments in which the baffle includes two pieces and a gap between the two pieces varies in size around a circumference of the baffle.
Figure 8B:
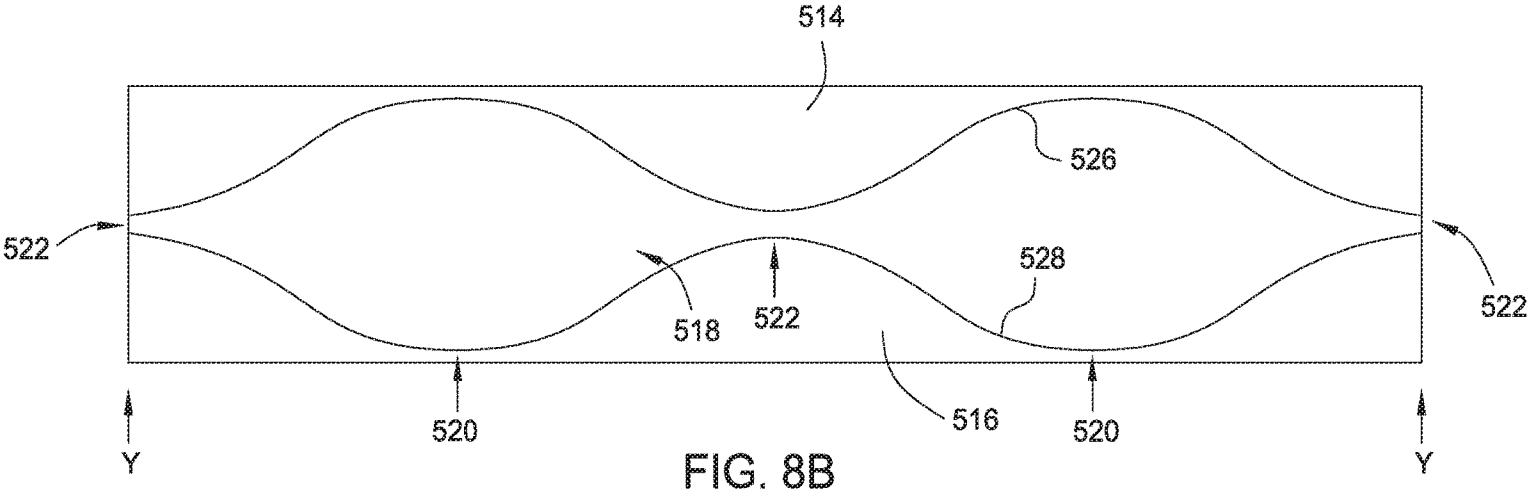
FIG. 8B is a view of surfaces of the baffle of FIG. 8A in which the surfaces along sides of the gap are flattened for illustration purposes.

FIGS. 8A and 8B illustrate another embodiment of a baffle 500. The baffle includes a first portion 502 and a second portion 504 which are physically separate. The first portion 502 includes a first surface 506 (e.g., which can rest against surface 238 of the box sub 202, illustrated in FIG. 2B). The first surface 506 includes a first plurality of apertures 508 arranged about its circumference. The second portion includes a second surface 510 (e.g., which can rest against surface 239 of the pin sub 204, illustrated in FIG. 2B). The second surface 510 includes a second plurality of apertures 512 arranged about its circumference. As discussed above, pins 250 (shown in FIG. 2B) can be inserted through ones of the apertures 508 and 512 to orient (i.e., clock) the first portion 502 and the second portion 504 relative to the ports 208. Since the first portion 502 and the second portion 504 are physically separate, each portion uses a pin 250 for orientation. The first portion 502 includes a third surface 514 and the second portion includes a fourth surface 516 that define a continuous orifice 518 therebetween. For illustration purposes, FIG. 8B shows the third surface 514 and the fourth surface 516 as if they were flattened out. The ends, labeled "Y," are where the flattened ends of the third surface 514 and the fourth surface 516 would be joined if they were in a hoop as shown in FIG. 8A. The third surface 514 ends in a non-uniform edge 526 and the fourth surface 516 ends in a non-uniform edge 528. By orienting the first portion 502 and the second portion 504 of the baffle 500 relative to each other, the non-uniform surfaces 526 and 528 can create wide regions 520 of the orifice 518 and narrow regions 522 of the orifice 518. In the instance shown in FIG. 8B, the orifice 518 includes two wide regions 520 arranged 180° apart and two narrow regions 522 arranged 180° apart and 90° apart from the wide regions 520. The first portion 502 and the second portion 504 can be oriented to form the wide regions 520 and the narrow regions 522 and to arrange the narrow regions 522 closest to the ports 208. As discussed above, the cement slurry will encounter more resistance to flow through the narrow regions 522 of the orifice 518 than through the wide regions 520 of the orifice 518. By aligning the narrow regions 522 of the orifice 518 with the ports 208, the total resistance to flow can be evenly distributed about the circumference of the baffle 500. The non-uniform edges 526 and 528 could include linearly-varying profiles, arcuate profiles, circular profiles, sinusoidal profiles, or the like.

In various embodiments, the orifice 518 of the baffle 500 could include more or fewer than two narrow regions 522 and two wide regions 520. For example, for the casing string collar 400 shown in FIGS. 7A-7D, the baffle 500 could include an orifice 518 with a single narrow region 522 and a single wide region 520. The single narrow region 522 could be arranged between the two ports 404 and 406 and the single wide region 520 could be arranged 180° apart from the narrow region 522.

Figure 9:
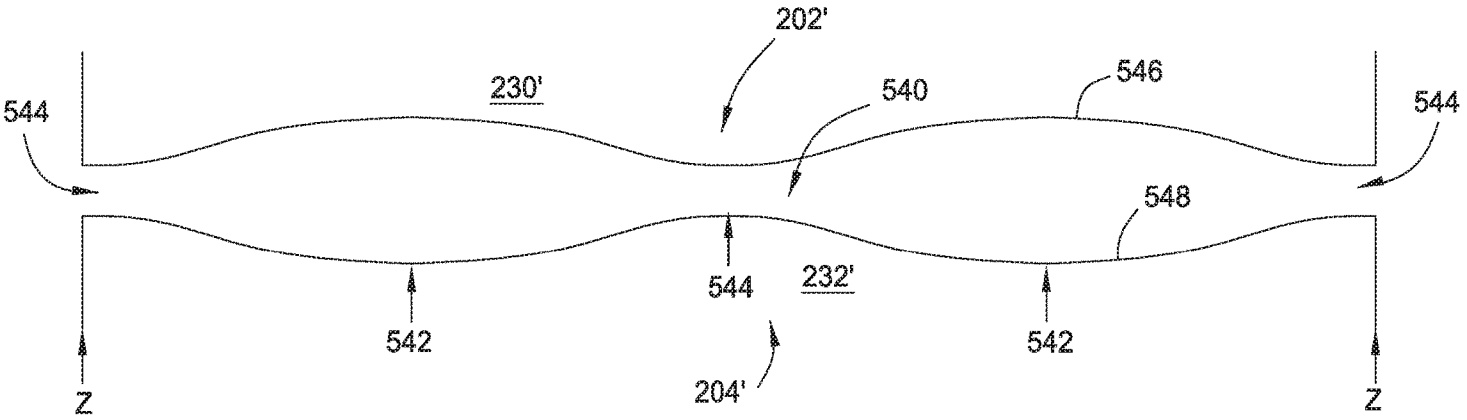
FIG. 9 is a view of ends of the box sub and pin sub shown in FIGS. 2A and 2B for an alternative embodiment in which a casing string collar does not include a baffle and in which ends of the box sub and pin sub have surfaces that provide a varying gap between the box sub and pin sub.

In various embodiments, a casing string collar could omit the baffle altogether. Referring again to FIGS. 2A and 2B, in various embodiments, edges of the box sub 202 and the pin sub 204 that form the gap G therebetween could include varying edges to vary a width of the gap G. FIG. 9 illustrates the distal end 230' of a box sub 202' and a proximal end 232' of a pin sub 204'. For illustration purposes, FIG. 9 shows the distal end 230' of the box sub 202' and the proximal end 232' of the pin sub 204' as if they were flattened out. The ends, labeled "Z," are where the flattened ends of the distal end 230' of the box sub 202' and the proximal end 232' of the pin sub 204' would be joined if they were in a hoop as shown in FIG. 2A. The distal end 230' of the box sub 202' includes a non-uniform edge 546 and the proximal end 232' of the pin sub 204' includes a non-uniform edge 548. The box sub 202' and the pin sub 204' are arranged in a body (e.g., body 206 shown in FIGS. 2A and 2B) such that the non-uniform edges 546 and 548 form a gap 540 therebetween that has wide regions 542 and narrow regions 544. In the instance shown in FIG. 9, the gap 540 includes two wide regions 542 arranged 180° apart and two narrow regions 544 arranged 180° apart and 90° apart from the wide regions 542. The box sub 202' and the pin sub 204' can be oriented to form the wide regions 542 and the narrow regions 544 and to arrange the narrow regions 544 closest to the ports 208. As discussed above, the cement slurry will encounter more resistance to flow through the narrow regions 544 of the gap 540 than through the wide regions 542 of the gap 540. By aligning the narrow regions 544 of the gap 544 with the ports 208, the total resistance to flow can be evenly distributed about the circumference of the gap 540. The non-uniform edges 546 and 548 could include linearly-varying profiles, arcuate profiles, circular profiles, sinusoidal profiles, or the like.

In various embodiments, the gap 540 could include more or fewer than two narrow regions 544 and two wide regions 542. For example, for the casing string collar 400 shown in FIGS. 7A-7D, the gap 540 could include a single narrow region 544 and a single wide region 542. The single narrow region 544 could be arranged between the two ports 404 and 406 and the single wide region 542 could be arranged 180° apart from the narrow region 544.

Figure 10A:
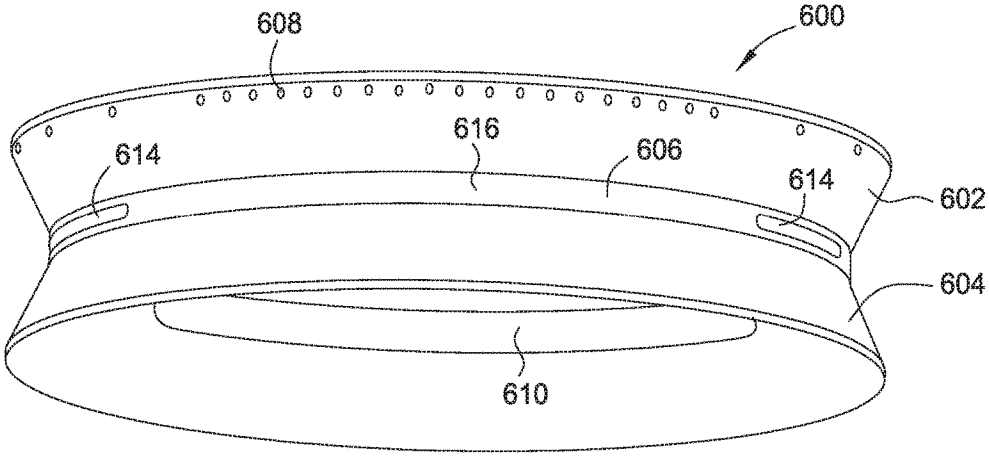
FIG. 10A is a perspective view of a baffle according to one embodiment for the casing string collar of FIG. 7A.
Figure 10B:
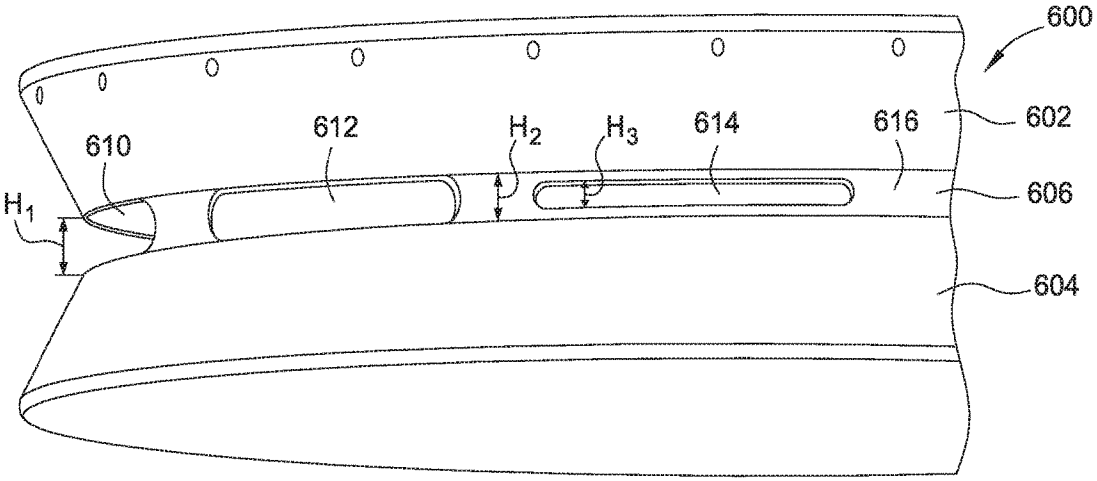
FIG. 10B is a side view of the baffle shown in FIG. 10A.

FIGS. 10A-10B illustrate another embodiment of a baffle 600 for use with the casing string collar 400. The baffle 600 includes a first surface 606 arranged between a second surface 602 and a third surface 604. The first surface 602 includes a series of apertures 608 that can receive a pin (e.g., pin 250 shown in FIGS. 2A and 2B). In various embodiments, the second surface 604 includes apertures 608 that can receive a pin. The first surface 606 includes elongate orifices 610, 612, and 614 arranged around a circumference of the first surface 606. A first elongate orifice 610 is arranged on the first surface 606. Second elongate orifices 612 are positioned on the first surface 606 on either side of the first elongate orifice 610 and third elongate orifices 614 are positioned on the first surface 606 outside of the second orifices 612. The first elongate orifice 610. The orifices 610, 612, and 614 are arranged on the first surface 606 toward a particular angular position on the first surface 606 such that an opposite angular position 616 contains no orifices. Furthermore, a flow area through the first elongate orifice 610 is larger than a flow area through the second elongate orifices 612 and the flow area through the second elongate orifices 612 is larger than a flow area through the third elongate orifices 614. In particular, the first orifice 610 defines a height $H_1$ that is larger than a height $H_2$ of the second orifices 612. Additionally, the first orifice 610 is longer (i.e., arranged across a longer arc length of the first surface 606) than the second orifices 612. The second orifices 610 may be longer, shorter, or the same length as the third orifices 612.

The baffle 600 can be used with the casing string collar 400 illustrated in FIGS. 7A and 7B. Similar to the embodiment shown in FIGS. 7A-7D, regardless of whether the rupture disc in port 406 bursts or the rupture disc in port 404 bursts, the asymmetric arrangement of the orifices 610, 612, and 614 and the different flow areas results in a total resistance to flow of cement slurry can be approximately equal about the entire circumference of the first surface 606 of the baffle 600 that includes the orifices. The largest orifice 610 is approximately 180° away from the ports 404 and 406. Thus, cement slurry passing through the largest orifice 610 (with a relatively low resistance to flow of cement slurry) will travel a relatively long distance through a ring-shaped volume (e.g., the ring-shaped volume 440 shown in FIG. 7C) to reach the port with the burst rupture disc. Similarly, cement slurry passing through the smallest orifice 614 (with a relatively large resistance to flow of cement slurry) will travel a relatively short distance through the ring-shaped volume to reach the port with the burst rupture disc.

In the various embodiments described above, the baffle or other flow-distributing structures can result in relatively high flow rates of cement slurry while reducing erosion of sealing surfaces that form a metal-to-metal seal after the cement flow has ceased. As a result, the sealing surfaces can be separated by a relatively small gap. The small gap reduces any burst and/or collapse forces imparted on the sealing surfaces and the sealing sleeve. In various embodiments, the relatively small burst and/or collapse forces experienced by the sealing surfaces and the sealing sleeve may allow for the use of inexpensive materials, such as steel alloys. Additionally, the relatively small burst and/or collapse forces experienced by the sealing surfaces and the sealing sleeve may allow for smaller component. Stated differently, if the gap (e.g., gap G shown in FIG. 4C) increases, then burst/collapse forces imparted on the sealing sleeve (e.g., sealing sleeve 212) would increase, and the wall thickness T of the sealing sleeve may need to increase to handle the increased forces. The increased wall thickness T of the sealing sleeve could reduce the size of the opening to downhole portions of the wellbore casing.

In at least one embodiment, a casing string collar for use with a casing string for a wellbore includes a tubular body having a port. The casing string collar also includes a baffle arranged between the port and an interior volume of the tubular body, wherein the baffle includes a plurality of orifices arranged around the baffle. The casing string collar also includes a sealing sleeve that is movable from a first position to a second position. The sealing sleeve forms at least one metal-to-metal seal that isolates the port and the baffle from the interior volume of the tubular body when the sealing sleeve is moved to the second position.

In at least one of the embodiments described above, the sealing sleeve forms the least one metal-to-metal seal with the tubular body.

In at least one of the embodiments described above, the sealing sleeve forms two metal-to-metal seals with the tubular body.

In at least one of the embodiments described above, the plurality of orifices includes a first orifice that is larger than a second orifice.

In at least one of the embodiments described above, the first orifice is located further away from the port than the second orifice.

In at least one of the embodiments described above, the plurality of orifices includes a first orifice that is larger than a second orifice.

In at least one of the embodiments described above, the first orifice is located further away from the port than the second orifice.

In at least one of the embodiments described above, the body comprises a first anti-rotation feature. The sealing sleeve further comprises a second anti-rotation feature. The second anti-rotation feature engages the first anti-rotation feature as the sealing sleeve moves from the first position toward the second position. The sealing sleeve does not rotate relative to the pin sub when the first anti-rotation feature and the second anti-rotation feature are engaged.

In at least one of the embodiments described above, the at least one metal-to-metal seal is not formed until the first anti-rotation feature and the second anti-rotation feature have engaged.

In at least one of the embodiments described above, the body defines a second port. The first port and second port are arranged 180° apart on the body. A first smallest size orifice is aligned with the first port and a second smallest size orifice is aligned with the second port. A first largest size orifice is aligned with a first position that is 90° apart from the first and second port and a second largest size orifice is aligned with a second position that is 90° apart from the first and second port.

In at least one of the embodiments described above, the body defines a second port. The first port and second port are arranged 180° apart on the body. The orifices are clustered in regions of the cylindrical surface of the baffle that are away from the first port and the second port.

In at least one of the embodiments described above, the body defines a second port. The first port and second port are arranged at less than 90° apart on the body. A smallest size orifice is aligned between the first port and the second port and a largest size orifice is aligned 180° apart on the baffle from the smallest orifice.

In at least one of the embodiments described above, the orifices are elongate orifices. The largest orifice is longer than remaining orifices.

In at least one of the embodiments described above, casing string collar further comprises a pin arranged in the baffle and the body, wherein the pin prevents rotation of the baffle relative to the body.

In at least one of the embodiments described above, a flow velocity of a cement slurry at any location around the baffle and upstream of the orifices is less than 100 feet per second for a desired total volumetric flow rate through the casing string.

In at least one of the embodiments described above, the flow rate is less than 50 feet per second.

In at least one embodiment, a casing string for a wellbore includes a first casing string section, a second casing string section, and a casing string collar arranged between the first casing string section and the second casing string section. The casing string collar includes a first port. The casing string collar also includes a baffle between the port and an interior volume of the casing string collar. The baffle includes a plurality of orifices arranged around the baffle. The casing string collar also includes a sealing sleeve that is movable from a first position to a second position. The sealing sleeve forms at least one metal-to-metal seal that isolates the port and the baffle from the interior volume of the casing string collar when the sealing sleeve is moved to the second position.

In at least one of the embodiments described above, the casing string collar further includes a box sub and a pin sub. The baffle is arranged in a gap between the box sub and the pin sub. The sealing sleeve is within the box sub in the first position. The sealing sleeve spans the gap in the second position. The sealing sleeve forms a first metal-to-metal seal with the pin sub in the second position. The sealing sleeve forms a second metal-to-metal seal with the box sub in the second position.

In at least one of the embodiments described above, the casing string collar includes a first anti-rotation member arranged on the sealing sleeve and a second anti-rotation member arranged on the pin sub. The first anti-rotation feature engages the second anti-rotation feature as the sealing sleeve moves from the first position to the second position. The first anti-rotation feature engages the second anti-rotation feature before the sealing sleeve forms the at least one metal-to-metal seal.

In at least one of the embodiments described above, the casing string collar further includes a second port that is arranged 180° apart from the first port. The orifices have varying sizes. A first smallest orifice is aligned with the first port. A second smallest orifice is aligned with the second port. A first largest orifice is 90° from the first smallest port, wherein a second largest orifice is 90° from the second smallest port. The orifices increase in size from the smallest orifice to the largest orifice.

In at least one of the embodiments described above, the casing string collar further includes a second port that is arranged 180° apart from the first port. The orifices are clustered in regions of the cylindrical surface of the baffle that are away from the first port and the second port.

In at least one of the embodiments described above, the casing string collar includes a second port that is arranged less than 45° apart from the first port. The orifices have varying sizes. A smallest aperture is aligned between the first port and the second port. A largest aperture is arranged 180° from the smallest aperture. The orifices increase in size from the smallest orifice to the largest orifice.

In at least one of the embodiments described above, wherein the casing string collar further comprises an anti-rotation member that engages the baffle to prevent movement of the baffle relative to the port.

In at least one embodiment, a method of arranging cement in an annulus between a wellbore and a casing string includes pumping cement slurry through a baffle and through a port. The baffle and the port are arranged between a first casing section and a second casing section of the casing string. The baffle includes a plurality of orifices about a circumference through which the cement slurry can flow. The method also includes moving a sealing sleeve from a first position to a second position. The sealing sleeve forms a metal-to-metal seal that isolates the baffle and the port from an interior volume of the casing string in the second position.

In at least one of the embodiments described above, moving the sealing sleeve from the first position to the second position includes pushing the sealing sleeve with a plug or dart.

In at least one of the embodiments described above, a method further comprises drilling through the plug or dart.

In at least one of the embodiments described above, pumping cement slurry through the plurality of orifices results in substantially even flow of the cement slurry about a circumference of the first casing section and the second casing section.

In at least one embodiment, a casing string collar for a casing string includes a box sub that includes a distal end. The box sub includes a first sealing element arranged around an interior surface proximate to the distal end. The distal end includes a first non-uniform edge. The casing string collar also includes a pin sub that includes a proximal end. The pin sub includes a second sealing element arranged around an interior surface proximate to the proximal end. The proximal end includes a second non-uniform edge. The casing string collar also includes a body that is engaged with the box sub and the pin sub. The first non-uniform edge of the box sub and the second non-uniform edge of the pin sub are spaced apart by a gap that includes a wide region and a narrow region when engaged with the body. The body defines a first port. The narrow region is aligned relative to the port. The casing string collar also includes a sealing sleeve arranged in the box sub. The sealing sleeve is movable toward the pin sub from a first position to a second position. The sealing sleeve includes a first sealing surface arranged to seal against the first sealing element of the box sub when the sleeve is moved to the second position. The sealing sleeve also includes a second sealing surface arranged to seal against the second sealing element of the pin sub when the sleeve is moved to the second position.

In at least one of the embodiments described above, the body defines a second port that is arranged 180° from the first port. The gap includes two narrow regions and two wide regions. The two narrow regions are aligned with respective ones of the first port and the second port. The two wide regions are aligned 90° away from the first port and the second port.

In at least one of the embodiments described above, the body defines a second port that is arranged less than 45° from the first port, wherein the narrow region is arranged between the first port and the second port.

In at least one embodiment, a casing string collar for a casing string includes a box sub that includes a distal end. The box sub includes a first sealing element arranged around an interior surface proximate to the distal end. The casing string collar also includes a pin sub that includes a proximal end. The pin sub includes a second sealing element arranged around an interior surface proximate to the proximal end. The casing string collar also includes a body that is engaged with the box sub and the pin sub. The distal end of box sub and the proximal end of the pin sub are spaced apart by a gap when engaged with the body. The body defines a first port. The casing string collar also includes a baffle arranged in the body. The baffle includes a cylindrical surface that covers the gap between the proximal end of the pin sub and the distal end of the box sub. The cylindrical surface includes a plurality of orifices arranged about a circumference of the cylindrical surface. The plurality of orifices includes orifices of different sizes. The cylindrical surface is oriented to align an orifice relative to the first port in the cylindrical body. The casing string collar also includes a sealing sleeve configured to selectively engage the first sealing element and the second sealing element to close the port from fluid communication.

In at least one of the embodiments described above, the sealing sleeve is arranged in the box sub. The sealing sleeve is movable from a first position to a second position toward the pin sub. The sleeve includes a first sealing surface arranged to form a metal-to-metal seal with the first sealing element of the box sub when the sleeve is moved to the second position. The sleeve also includes a second sealing surface arranged to form a metal-to-metal seal with the second sealing element of the pin sub when the sleeve is moved to the second position.

In at least one of the embodiments described above, the pin sub further comprises a first anti-rotation feature. The sealing sleeve further comprises a second anti-rotation feature. The second anti-rotation feature engages the first anti-rotation feature as the sealing sleeve moves from the first position toward the second position. The sealing sleeve does not rotate relative to the pin sub when the first anti-rotation feature and the second anti-rotation feature are engaged.

In at least one of the embodiments described above, the first sealing surface does not seal against the first sealing element and the second sealing surface does not seal against the second sealing element until the first anti-rotation feature and the second anti-rotation feature have engaged.

In at least one of the embodiments described above, the body defines a second port. The first port and second port are arranged 180° apart on the body. A first smallest size orifice is aligned with the first port and a second smallest size orifice is aligned with the second port. A first largest size orifice is aligned with a first position that is 90° apart from the first and second port. A second largest size orifice is aligned with a second position that is 90° apart from the first and second port.

In at least one of the embodiments described above, the body defines a second port. The first port and second port are arranged 180° apart on the body. The orifices are clustered in regions of the cylindrical surface of the baffle that are away from the first port and the second port.

In at least one of the embodiments described above, the body defines a second port. The first port and second port are arranged at less than 90° apart on the body. A smallest size orifice is aligned between the first port and the second port. A largest size orifice is aligned 180° apart on the baffle from the smallest orifice.

In at least one of the embodiments described above, wherein the casing string collar further comprises a pin arranged in the baffle and the pin sub. The pin prevents rotation of the baffle relative to the pin sub.

In at least one of the embodiments described above, the cylindrical surface of the baffle is oriented to align a smallest orifice with the first port in the cylindrical body.

In at least one of the embodiments described above, the sealing sleeve defines a wall thickness. The gap has a dimension that is between one-half and one-and-a-half times the wall thickness defined by the sealing sleeve.

In at least one of the embodiments described above, the gap has a dimension that is less than a radius dimension of the first port.

In at least one embodiment, a casing string collar for use with a casing string for a wellbore includes a tubular body having a port. The casing string collar also includes a baffle arranged between the port and an interior volume of the tubular body. The baffle includes a first portion and a second portion. The first portion of the baffle and the second portion of the baffle are spaced apart in a non-uniform manner around a circumference to form a gap having at least one wide region and at least one narrow region. The at least one narrow region is aligned relative to the port. The casing string collar also includes a sealing sleeve that is movable from a first position to a second position. The sealing sleeve forms at least one metal-to-metal seal that isolates the port and the baffle from the interior volume of the tubular body when the sealing sleeve is moved to the second position.

While the foregoing is directed to embodiments of the present invention, other and further embodiments of the invention may be devised without departing from the basic scope thereof, and the scope thereof is determined by the claims that follow.

The invention claimed is:

1. A casing string collar for use with a casing string for a wellbore, the collar comprising:

a tubular having a port;

a baffle arranged between the port and an interior volume of the tubular, wherein the baffle includes a plurality of orifices arranged around the baffle; and a sealing sleeve that is movable from a first position to a second position, the sealing sleeve having a flow bore, wherein the sealing sleeve forms at least one metal-to-metal seal with the tubular that isolates the port and the baffle from the flow bore when the sealing sleeve is moved to the second position.

2. The casing string collar of claim 1, wherein the plurality of orifices includes a first orifice that is larger than a second orifice.

3. The casing string collar of claim 2, wherein the first orifice is located further away from the port than the second orifice.

4. The casing string collar of claim 1, wherein the tubular comprises a first anti-rotation feature, wherein the sealing sleeve further comprises a second anti-rotation feature, wherein the second anti-rotation feature engages the first anti-rotation feature as the sealing sleeve moves from the first position toward the second position, and wherein the sealing sleeve does not rotate relative to the tubular when the first anti-rotation feature and the second anti-rotation feature are engaged.

5. The casing string collar of claim 1, wherein the port is a first port, wherein the tubular defines a second port, wherein the first port and second port are arranged 180° apart on the tubular, wherein a first smallest size orifice is aligned with the first port and a second smallest size orifice is aligned with the second port, wherein a first largest size orifice is aligned with a first position that is 90° apart from the first and second port, and wherein a second largest size orifice is aligned with a second position that is 90° apart from the first and second port.

6. The casing string collar of claim 1, wherein the port is a first port and the tubular further includes a second port, wherein the first port and second port are arranged 180° apart on the tubular, and wherein the orifices are clustered in regions of a cylindrical surface of the baffle that are away from the first port and the second port.

7. The casing string collar of claim 1, wherein the port is a first port and the tubular further includes a second port, wherein a smallest size orifice is aligned between the first port and the second port, and wherein a largest size orifice is aligned 180° apart on the baffle from the smallest orifice.

8. The casing string collar of claim 7, wherein the orifices are elongate orifices, wherein the largest orifice is longer than remaining orifices.

9. The casing string collar of claim 1, further comprising a pin arranged in the baffle and the tubular, wherein the pin prevents rotation of the baffle relative to the tubular.

10. A casing string for a wellbore, the casing string comprising:

a first casing string section;

a second casing string section; and a casing string collar arranged between the first casing string section and the second casing string section, wherein the casing string collar includes:

a tubular having a first port;

a baffle between the first port and an interior volume of the casing string collar, wherein the baffle includes a plurality of orifices arranged around the baffle; and a sealing sleeve that is movable from a first position to a second position, the sealing sleeve having a flow bore, wherein the sealing sleeve forms at least one metal-to-metal seal with the tubular that isolates the port and the baffle from the flow bore-when the sealing sleeve is moved to the second position.

11. The casing string of claim 10, wherein:

the tubular is a tubular body having the first port, a first sub, and a second sub;

the baffle is arranged in a gap between the first sub and the second sub; and the sealing sleeve is within the first sub in the first position, wherein:

the sealing sleeve spans the gap in the second position, the at least one metal-to metal seal with the tubular is a first metal-to-metal seal and a second metal-to-metal seal, the sealing sleeve forms the first metal-to-metal seal with the second sub in the second position, and the sealing sleeve forms the second metal-to-metal seal with the first sub in the second position.

12. The casing string of claim 10, wherein the casing string collar further includes a second port that is arranged 180° apart from the first port, wherein the orifices have varying sizes, wherein a first smallest orifice is aligned with the first port, wherein a second smallest orifice is aligned with the second port, wherein a first largest orifice is 90° from the first port, wherein a second largest orifice is 90° from the second port, and wherein the orifices increase in size from the smallest orifice to the largest orifice.

13. The casing string of claim 10, wherein the casing string collar further includes a second port that is arranged 180° apart from the first port, wherein the orifices are clustered in regions of a cylindrical surface of the baffle that are away from the first port and the second port.

14. The casing string of claim 10, wherein the casing string collar includes a second port, wherein the orifices have varying sizes, wherein a smallest orifice is aligned between the first port and the second port, wherein a largest orifice is arranged 180° from the smallest orifice, and wherein the orifices increase in size from the smallest orifice to the largest orifice.

15. The casing string collar of claim 10, further comprising an anti-rotation member that engages the baffle to prevent movement of the baffle relative to the port.

16. A method of arranging cement in an annulus between a wellbore and a casing string, the method comprising:

pumping a cement slurry through a baffle and through a port in a tubular, wherein the baffle and the tubular are arranged between a first casing section and a second casing section of the casing string, and wherein the baffle includes a plurality of orifices about a circumference through which the cement slurry can flow; and moving a sealing sleeve from a first position to a second position, the sealing sleeve having a flow bore, wherein the sealing sleeve forms a metal-to-metal seal with the tubular that isolates the baffle and the port from the flow bore in the second position.

17. The method of claim 16, wherein moving the sealing sleeve from the first position to the second position includes pushing the sealing sleeve with a plug or dart.

18. A casing string collar for use with a casing string for a wellbore, the collar comprising:

a tubular having a port;

a baffle arranged between the port and an interior volume of the tubular, wherein the baffle includes a plurality of orifices arranged around the baffle, wherein the plurality of orifices includes a first orifice that is larger than a second orifice; and a sealing sleeve that is movable from a first position to a second position, the sealing sleeve having a flow bore, wherein the sealing sleeve forms at least one metal-to-metal seal that isolates the port and the baffle from the flow bore when the sealing sleeve is moved to the second position.

19. The casing string collar of claim 18, wherein the sealing sleeve forms the at least one metal-to-metal seal with the tubular.

20. The casing string collar of claim 18, wherein the first orifice is located further away from the port than the second orifice.

21. The casing string collar of claim 18, wherein the port is a first port and the tubular further includes a second port, wherein the first port and second port are arranged 180° apart on the tubular, and wherein the orifices are clustered in regions of a cylindrical surface of the baffle that are away from the first port and the second port.

22. The casing string collar of claim 18, wherein the port is a first port and the tubular further includes a second port, wherein the second orifice is aligned between the first port and the second port, and wherein the first orifice is aligned 180° apart on the baffle from the second orifice.

23. The casing string collar of claim 22, wherein the orifices are elongate orifices, wherein the first orifice is longer than remaining orifices.

* * * * *